US012428830B2

(12) United States Patent
Miles et al.

(10) Patent No.: US 12,428,830 B2
(45) Date of Patent: Sep. 30, 2025

(54) MODULAR STRUCTURE

(71) Applicant: UPSHOT INTELLECTUAL HOLDINGS LIMITED, Dorset (GB)

(72) Inventors: John Miles, Dorset (GB); James Pickance, Dorset (GB)

(73) Assignee: UPSHOT INTELLECTUAL HOLDINGS LIMITED, Dorset (GB)

( * ) Notice: Subject to any disclaimer, the term of this patent is extended or adjusted under 35 U.S.C. 154(b) by 406 days.

(21) Appl. No.: 17/791,646

(22) PCT Filed: Jan. 8, 2021

(86) PCT No.: PCT/GB2021/050049
§ 371 (c)(1),
(2) Date: Jul. 8, 2022

(87) PCT Pub. No.: WO2021/140339
PCT Pub. Date: Jul. 15, 2021

(65) Prior Publication Data

US 2023/0024343 A1 Jan. 26, 2023

(30) Foreign Application Priority Data

Jan. 10, 2020 (GB) ..... 2000410

(51) Int. Cl.
*E04B 1/19* (2006.01)
*E04H 12/00* (2006.01)

(52) U.S. Cl.
CPC ..... *E04B 1/19* (2013.01); *E04H 2012/006* (2013.01)

(58) Field of Classification Search
CPC ..... E04B 1/19; E04H 2012/006
USPC ..... 52/645
See application file for complete search history.

(56) References Cited

U.S. PATENT DOCUMENTS

| | | | | |
|---|---|---|---|---|
| 4,137,354 | A * | 1/1979 | Mayes, Jr. | B29C 70/382 428/36.1 |
| 11,242,691 | B2 * | 2/2022 | Williams | E04H 3/30 |
| 2010/0075074 | A1 * | 3/2010 | Wilson | B29C 53/821 425/441 |
| 2022/0205233 | A1 * | 6/2022 | Curtis | E04B 1/28 |
| 2024/0301676 | A1 * | 9/2024 | Kajikawa | E04B 1/19 |

FOREIGN PATENT DOCUMENTS

| | | |
|---|---|---|
| CN | 107724709 | 2/2018 |
| EP | 2716828 | 4/2014 |
| WO | 2012/095721 | 7/2012 |
| WO | 2012/159046 | 11/2012 |
| WO | 2014/005177 | 1/2014 |
| WO | 2014/007563 | 1/2014 |

OTHER PUBLICATIONS

International Search Report issued in International Patent Application No. PCT/GB2021/050049 on Apr. 29, 2021.

* cited by examiner

*Primary Examiner* — James J Buckle, Jr.
(74) *Attorney, Agent, or Firm* — Whiteford, Taylor & Preston, LLP; Peter J. Davis

(57) ABSTRACT

A modular structural element (20) which is arranged to be connected to another such element so as to form an assembled structure, wherein the modular structural element is of substantially square outline or of substantially hexagonal or half-hexagonal outline, and the element comprises a principal height dimension and a principle lateral dimension, wherein, a ratio of the two said principal dimensions is no more than 6.

17 Claims, 24 Drawing Sheets

MAST BRACING MK1

CONTAINER END CABIN

LENGTHS OF HEX OR BOX SECTIONS CAN BE PRE-ASSEMBLED OFF SITE AS REQUIRED

ALTERNATIVELY THEY CAN BE ASSEMBLED ON SITE TO CRANE INTO PLACE

STACK OF HEX SECTIONS

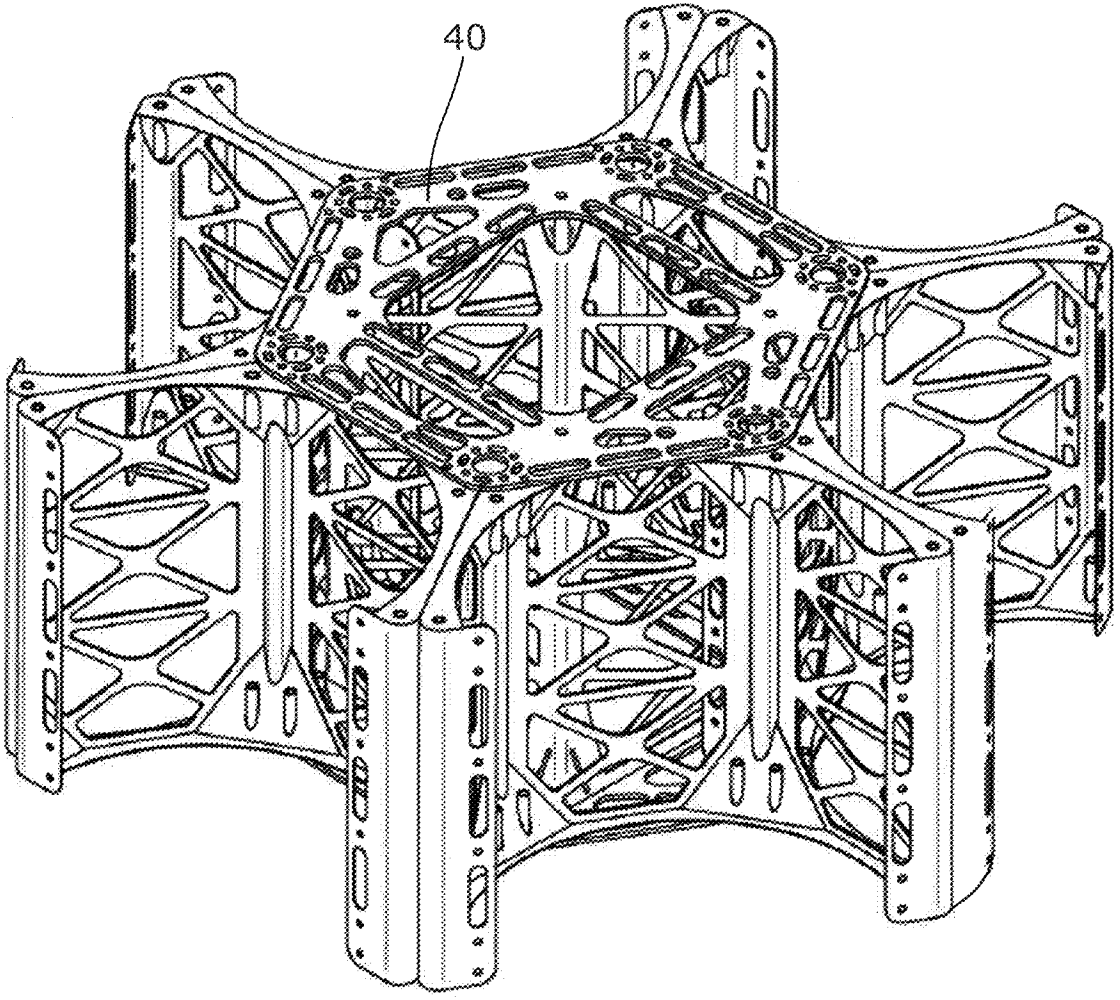
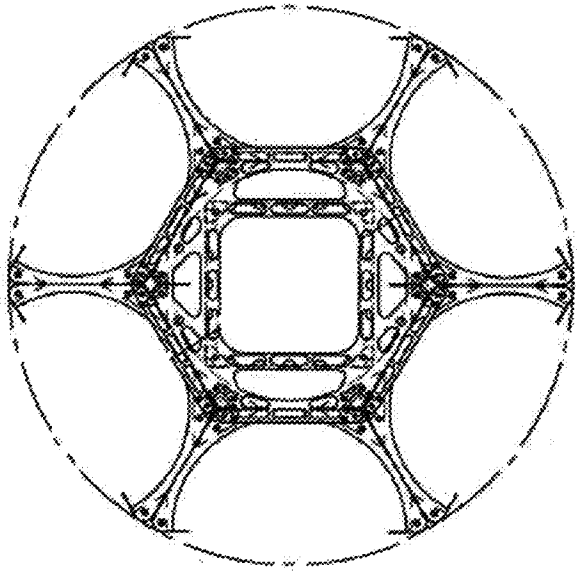
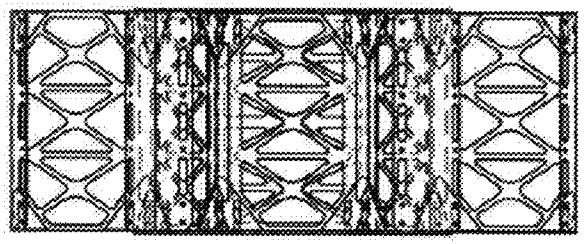
FIGURE 7 SAMPLE BASE ASSEMBLY

INTERPLATE

CUBE FIT INTO HEX VIA INTERPLATE

1m ANTENNA SECTION

A STANDARD ANTENNA SUB ASSEMBLY COMPRISING A BOX SECTION AND SIX PILLARS ON AN INTERPLATE. THESE COMPONENTS ARE NOT CONNECTED UNTIL OFFERED UP TO ALREADY ASSEMBLED COMPONENTS SINCE THEY BOLT TOGETHER.

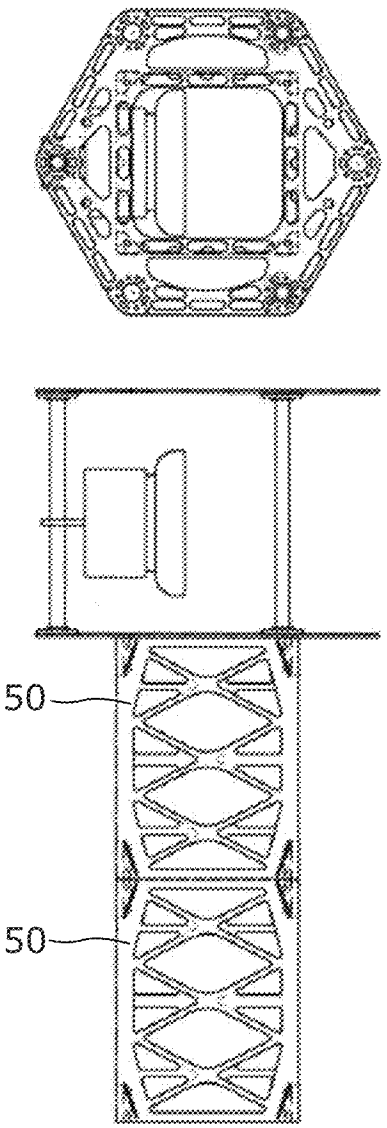
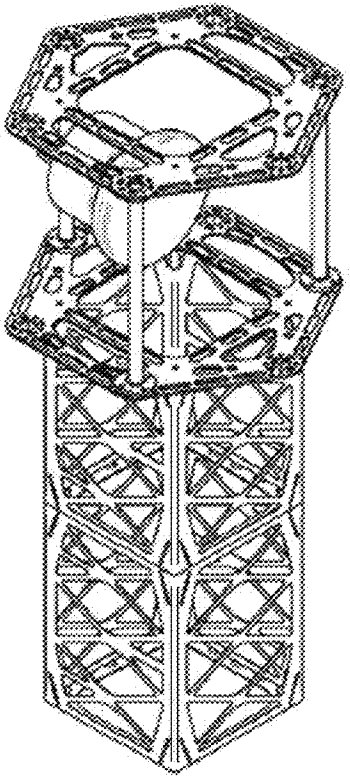
A SAMPLE HERE OF THE ASSEMBLY OF TWO BOX SECTIONS THEN THREE PILLARS BETWEEN TWO INTERPLATES
SAMPLE MAST TOP SECTION
FIGURE 13

VIEWS OF THE HEXBOX SYSTEM DESIGNED TO RECEIVE A FULL 5g ANTENNA FIT.

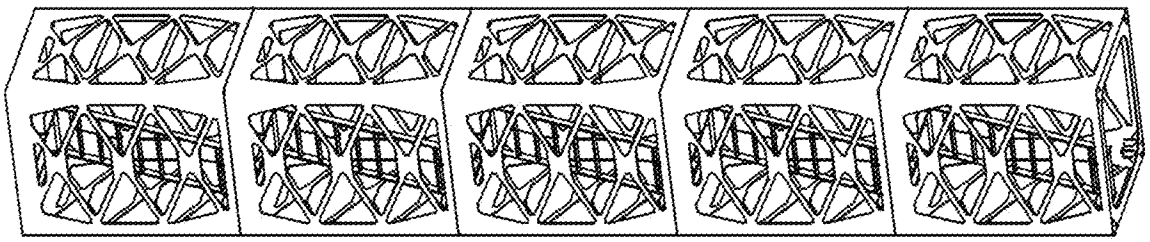
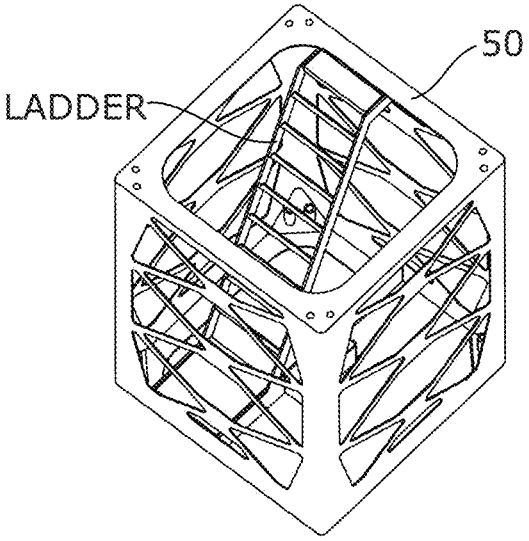
FIGURE 15

MODULAR STRUCTURE

TECHNICAL FIELD

The present invention relates to modular structures.

SUMMARY

According to a first aspect of the invention there is provided a modular structural element which is arranged to be connected to another such element so as to form an assembled structure, wherein the modular structural element is of substantially square outline or is of substantially hexagonal or half-hexagonal outline, and the element comprises a principal height dimension and a principal lateral dimension, wherein, a ratio of the two said principal dimensions is no more than 6.

The principal lateral dimension may be smaller than the principal height dimension.

The principal height dimension may be smaller than the principal lateral dimension.

Broadly, the principal height dimension may be unequal to the principal lateral dimension. However, the principal height dimension may be substantially equal to the principal lateral dimension.

The modular structural element may be of any (regular) polygonal shape.

By 'outline', we include the configuration of the outermost margin/periphery of the respective element, or this may be expressed as an external outline of the element. By 'outline' we may include that the lateral dimension being the diameter of a circumscribing circle in plan.

The principal lateral dimension may be substantially orthogonal to the principal height dimension.

The principal lateral dimension may be the largest linear dimension or extent of the spatial extent of the element when viewed in plan.

In the case of the principal lateral dimension of the modular structural element having a square outline it is that of the distance from one vertex to an opposite vertex. This may also or alternatively be the diameter of a circumscribing circle, which is contiguous with four corners of the modular element of square outline.

In the case of the principal lateral dimension of the modular structural element having a hexagonal or half-hexagonal outline, the distance may be that of the distance from one vertex to an opposite vertex. This may also or alternatively be the diameter of a circumscribing circle which is contiguous with vertices of the hexagonal outline.

The square shape modular element may comprise a transverse section which is substantially square. The square shape/section modular structural element may be of cuboid form. The square/section modular structural element may be of substantially rectangular parallelepiped form.

The hexagonal shape element may comprise a transverse section which is substantially hexagonal in outline.

One principal dimension may be no more than 1.75 times the other principal dimension.

One principal dimension may be no more than 1.5 times the other principal dimension.

One principal dimension may be no more than 1.25 times the other principal dimension.

One principal dimension may be no more than 2.25 times the principal dimension.

One principal dimension may be no more than 2.5 times the other principal dimension.

One principal dimension may be no more than 2.75 times the other principal dimension.

One principal dimension may be no more than 3.0 times the other principal dimension.

One principal dimension may be no more than 3.25 times the other principal dimension.

One principal dimension may be no more than 3.5 times the other principal dimension.

One principal dimension may be no more than 3.75 times the other principal dimension.

One principal dimension may be no more than 4 times the other principal dimension.

One principal dimension may be no more than 4.25 times the other principal dimension.

One principal dimension may be no more than 4.5 times the other principal dimension.

One principal dimension may be no more than 4.75 times the other principal dimension.

One principal dimension may be no more than 5 times the other principal dimension.

One principal dimension may be no more than 5.25 times the other principal dimension.

One principal dimension may be no more than 5.5 times the other principal dimension.

One principal dimension may be no more than 5.75 times the other principal dimension.

The ratio of one principal dimension to the other may be in a range bounded by any combination of two of the dimension ratios set out above. For example, one the ratios above may set an upper limit on the ratio of the principal height dimension to the principal lateral dimension, whereas another (i.e. different in value) of the ratios may set an upper limit on the ratio of the principal height dimension to the principal lateral dimension. Alternatively, the same ratio value may be used to determine a bounded range. For example, the ratio of the principal height dimension to the principal lateral dimension may be 1.5, and similarly that of the principal height dimension to the principal lateral dimension may also be 1.5. Such bounded ranges may determine the possible range of ratio values in which the ratio of the principal dimensions of the modular element is required to be within.

A hexagonal modular element may comprise six sides, and a half-hexagonal module may comprise three sides.

Each side may extend substantially from one distal end to an opposite distal end (in the direction of the height of the modular element).

The modular element may alternatively be termed a module, a unit, a section a part or a component.

The modular element may define an internal space, i.e. a space which is internal of its sides. The modular element may be termed a hollow entity.

The modular element may comprise a first open distal end and an opposite open distal end. The modular element may be described as an open-ended modular element.

A half-hexagonal element may be arranged to be connected to another half hexagonal element to form a modular structural element which is of hexagonal outline.

A half hexagonal element may comprise an interface which is arranged to be joined to or connected to an interface of a second half hexagonal element. The interface may comprise one or more apertures to receive a fastener for connecting two half hexagonal elements together. The interface may comprise an inwardly directed flange.

The connecting faces may project inwards from opposing vertices of the half hexagonal shape, and may be provided with connecting features and apertures that may be used, though not exclusively, as hand holds (for example, to facilitate manual or machine transportation to an assembly location).

The interface may comprise a surface portion which is arranged to be maintained in face-to-face contact with an interface of another half hexagonal modular element.

The diameter of the circular internal edge of a distal end may substantially correspond to the principal lateral circumscribing circle dimension of the square element, so as to accommodate the square modular element within the hexagon.

At least one of both of the distal ends of the modular structural element comprises one or more apertures arranged to allow connection to an adjacent element and/or to a connector component.

In respect of the square and hexagonal modular elements there may be provided a common arrangement of the corners extending between the open distal ends by way of column formations. The column formations may extend along edges where two adjacent module sides meet; and being, on occasion, where the panels generating the edge are perforated or apertured and may be further or alternatively defined by a lack of panel perforation/aperture. These column formations may terminate with the addition of short sloped panels between the inside of the column corner and an open distal end, through which structural tubes running axially in parallel with the column facilitate the fastening of the distal end of one modular element to the distal end of another modular element of similar geometric origin/basis (square or hexagon). The arrangement of a connected series of such modular elements may be perceived as a hollow tubular form of the respective square or hexagonal cross section. These assembled structures may (then) be arranged, in whole or part, to be of solid or perforated/apertured wall form by use of solid wall or panel elements.

Some or each of the sides/side faces of the modular element may comprise a number of structural formations or members which are substantially co-planar.

Each or some of the sides may comprise a number of apertures or through-holes, in the intervening space between and adjacent to the structural formations, or which structural formations define the apertures/through-holes.

The sides of the modular structural element may be termed panels.

The panels forming the sides between distal ends of the modular element may be fully obscure or may contain apertures or be perforated.

In the apertured form, the sides may be considered as comprising a 'lattice' structure.

The structural formations of the sides may be termed ribs, cross-members or limbs.

The sides of the modular element may be cage-like.

The sides may be viewed as being of exoskeletal form.

Each or some of the sides/side faces may be of open or non-solid or apertured form.

An internal surface of the hexagonal element and the half hexagonal element may be circular or part circular. Said internal surface at least in part defines the extent of an internal space of either element. Each element may have an upper such circular internal surface and a lower such circular internal surface. Said two internal surfaces may be spaced apart by substantially the height of the respective element, and may be located at or next to each distal end.

The modular structural element may comprise a stairway or ladder within its internal space, which extends from a region at or proximal to a first distal end to a region at or proximal to an opposite distal end.

According to a further aspect of the invention there is provided a plurality of the modular structural elements of the first aspect of the invention for realising an assembled structure comprising said elements in a connected configuration.

This aspect may be considered as a kit or collection of (unassembled) parts (for use in creating an assembled structure).

The kit may be arranged for assembly and installation of an upright structure at a required location. The kit may include some of the modular elements preassembled/preconnected into sub-assemblies for ease of installation. The pre-assembly of some of the modular elements into sub-assemblies provides the advantage to more quickly and easily create the intended assembled structure.

The modular structural elements may be arranged to be connected together directly (for example with intimate contact between adjacent elements), or indirectly (for example by way of a connecting intervening component).

The plurality of modular structural elements may comprise multiple hexagonal modular elements and/or multiple half hexagonal elements. The plurality of modular structural elements may comprise multiple square modular structural elements.

The plurality of modular structural elements may comprise at least one hexagonal element and/or at least two half hexagonal modular elements, and at least one square modular element.

The plurality of modular elements may comprise at least two multiple modular structural elements having substantially the same sized and shaped distal ends.

An internal space of a hexagonal element (which may be formed as a unitary entity or by joining two half hexagonal elements), may be configured so as to receive a square modular element therein.

The hexagonal modular element may be arranged to receive the square element therein. In this arrangement, the structural advantage provided by both elements is provided within the spatial volume occupied by the hexagonal element alone.

A hexagonal element, a square element and a half hexagonal element may have substantially the same height.

The principal lateral dimension of a hexagonal element or a half hexagonal element may be larger than the principal lateral dimension of a square modular element.

A first one of the modular structural elements may comprise a plurality of sides, each of which is interfaceable with any of the sides of a second modular structural element. The sides of the first modular structural element may be of substantially the same size and shape as each of the sides of the second modular structural element. Each of the sides of the elements may be termed side faces. Each of the sides of the first and second modular structural elements may be arranged to interface with one side of the first element facing opposite to and/or in face-to-face contact with a side of the second element. The modular structural elements may be arranged to be fixedly connected together in this interfacing side-by-side arrangement.

More than two of the modular structural elements of the kit have sides which are interfaceable as defined in the immediately preceding paragraph.

According to another aspect of the invention there is provided a modular structure which comprises multiple modular elements of the first aspect of the invention, assembled together.

The (assembled) modular structure may be an upright structure and/or may comprise a lateral structure of a particular type that may be a basal structure.

By 'upright structure' we include an entity which extends vertically upwards, and which is located on or fixed into/onto/relative to the ground or a base of some kind.

A 'lateral structure' may be the lateral assembly, panel exterior face to panel exterior face, of numbers of entities with common panel geometry.

A lateral structure may be of a number of one entity type only, or comprise entities of different types.

The basal structure may be arranged to comprise a support or mount, which may be for the upright structure or otherwise.

The upright structure may comprise or be described as a mast or a tower.

The modular elements may be connected together by way of any suitable fastener, or a number of different fasteners.

The one or more modular elements of hexagonal shape may have sides which are arranged in substantially hexagonal outline (when viewed in plan). The one or more modular elements of square outline may have sides which are arranged in substantially square shape (when viewed in plan).

The modular structure may be a permanent, semi-permanent or temporary structure.

The upright structure may be arranged to support a load, such as a load secured to an upper part thereof.

Said upright structure may be termed a column or pillar.

In lateral applications as a basal structure, the modular elements may be arranged to tile into square and/or hexagonal pattern structural plan forms.

In lateral applications in any application, differing modular elements, but of common panel geometry, may be arranged to tile into any combination of square and/or hexagonal pattern structural plan forms.

In lateral applications/realisations the assembled modular structure may be termed a base, a beam or a layer.

When the modular structure comprises an upright structure, this may be arranged to support equipment, as example the antennae or communications equipment, such as that used for a cellular communications network. Such an upright structure may alternatively or in addition be used, for example, for military surveillance equipment and/or as a look-out or surveillance position.

In the assembled structure, the modular elements may be stacked one above the other either directly (so that for example adjacent modules are in direct physical contact) or indirectly (so that for example adjacent modules contact an intermediary formation/component which is located between the two modules).

The modular structure may be described as substantially formed of a plurality of modular elements, in which the principal/primary parts which provide the main structure are substantially the square shape, substantially hexagonal shape, and/or of substantially half-hexagonal shape.

A hexagonal structural element, may comprise a single fabricated structure, may be interchanged within any arrangement with a hexagonal structural element which comprises two adjoined half-hexagonal elements.

Put differently, a hexagonal structural element may comprise two half hexagonal modules connected together, and/or may be a single module, formed as an integral entity.

The modular structure may comprise a combination of different varieties of (i) base structures, (ii) vertical structural arrangements, (iii) modular adaptations to facilitate attachment of equipment, and/or (iv) supporting guy lines. Guy lines may be fixed directly to the base, or set to or into ground or a (separate) weight may be provided outside the plan-form structural circumference of the base.

In an upright structure, such as a tower or a mast, a lower portion may comprise multiple hexagonal elements and an upper portion may comprise multiple square section elements. Such an upright structure may comprise an intermediate region in which one or more square section elements extend, at least partially or wholly, into one or more hexagonal elements.

An arrangement of hexagonal elements forming a structural base to a vertical assembly comprising square outline elements and/or hexagonal outline elements may comprise multiple hexagonal elements and/or multiple half-hexagonal elements, connected. The base may be arranged to house geometrically compatible weights within the structural elements forming the base, and an interface between a structural element and the weight(s) may comprise an additional, adaptive kit of structural pieces/components.

The modular elements when connected together in the assembled condition may be viewed as providing the primary structural integrity of the assembled structure.

The modular elements may orient most commonly with defining square and hexagonal geometry perceived in plan form, which reveals in profile as two open distal ends of that geometry separated by vertical structural planes ('panels'), arranged around that geometric perimeter.

The distance between the opposing distal ends of each, some or most of the modular structural elements is substantially the same, which distance may be the (principal) height (dimension) of each element. Said distance may identify as the modular element height (Hm). Said height may be a defining scaling dimension for the overall modular system. Advantageously, the modular system may be defined at any scale and structured accordingly. It will be appreciated that all of the modular structural elements of an assembled structure need not necessarily be of substantially the same height.

A modular scale, which may be denoted Hm, and which may be defined as equal to the height of the modular elements, may nominally equal substantially one metre, and the modular system, at this modular scale or less, may be devised so that every modular structural element weighs less than 50 kg. The modular scale may nominally equal substantially 2 m.

Provision may be made as part of the structure for humans to climb either inside and/or outside the structure. To facilitate this further the geometry of a lattice formation of one, some or all of the side panels of at least some of the elements may be arranged to provide regularly spaced positions for foot and hand purchase during climbing.

For any scale modular system, further use-specific structural detail can be added where the fundamental module structure is maintained.

Provision may be made through module panels for human access.

Provision may be made to allow humans to elevate up through the assembled modular elements. This may be by the addition of internal ladder, stair or mechanical elevator/lift.

The present invention, in yet a further aspect, provides for a plate of configuration arranged to enable the modular elements to connect respective by distal ends of two modular elements. Such a plate may comprise a hexagonal outline and which may be termed an interplate. There may also be provided a versatile plate component identified as a link plate which serves to connect modular elements together in transverse/lateral fashion.

The interplate may be provided with a plurality of apertures. The interplate may be shaped/sized to exceed an outer perimeter of its compatible host hexagonal modular element by so much as to be able to attach, to the side of that host module, or laterally, other adjacent modules.

The link plate (which may also be referred to as a HexLink) may be shaped to fasten the singular merging of up to three Hex modules laterally at once, for example. The link plate may also carry an additional hole pattern to add the ability of the link plate to incorporate modular components identified as poles to the modular assembly.

There may be provided a slender or elongate component that may be arranged as a pipe with flanged ends. This component may be described as a pole. The overall length of a pole may match exactly that distance between the distal ends of the modular element(s). This common distance/metric may be identified as/termed the module scale dimension, Hm.

The interplate, square modular element and pole may be devised such that said modular element and six poles can be fastened to the interplate where each pole aligns where the columns on a hexagonal modular element would otherwise be if similarly aligned to the interplate. In this way the interplate may serve to transition structural loads between module types during changes between one modular type and another throughout assembly arrangements.

According to another aspect of the invention there is provided a structural module that may be described as a cabin or frame. The cabin is an enclosed structural space, room or compartment, arranged so that it can be attached to an end of a standard ISO-compliant shipping container by way of the recognised container system Twistlock® system only. The frame is the same bar lack of exterior enclosure paneling and functions in substantially similar fashion. The cabin is so devised as to be constrained within the end geometry of the ISO container, such that the container, when fitted with the cabin, can conveniently be transported by conventional transportation vehicles.

The cabin may be provided with sufficient structure to support modular mast structures arranged onto the cabin top.

The cabin may be arranged to have attached fold-out or articulated supporting braces.

There may be provided in the cabin enclosure securable/lockable human access from outside comprising a lockable door, and up into the base of the mast through the top of the cabin.

A further aspect of the invention is a method of constructing an upright structure using a plurality of the modules referred to above.

Any of the aspects of the invention as set out above may include one or more features disclosed in the description and/or as disclosed in the Figures, either singularly or in combination.

BRIEF DESCRIPTION OF THE DRAWINGS

Various embodiments of the invention will now be described, by way of example only, with reference to the drawings, in which:

FIGS. 6 and 7 show two embodiments of basal assemblies.

FIG. 13 shows two interplates separated by three mounting poles, collectively mounted to the top of a stack of two square section elements, FIG. 15 shows a perspective view of a square section element which is of sufficient size to contain within a secondary ladder and platform arrangement, as well as a perspective view which shows a number of such elements vertically stacked, and provides an access way for people to pass therein.

DETAILED DESCRIPTION

There are now described various embodiments of a novel modular structural system which comprises modular structural elements which can be connected together to form a modular structure.

Reference is made initially to FIG. 1 which shows an upright assembled structure 10, which is provided with a base (a cabin plus an ISO-compliant shipping container) 3 and a vertical assembly 5 which is supported on the base. As will be described in detail below, the assembled structure is modular and is formed primarily of square, hexagonal ('Hex') or part-hexagonal ('HalfHex') modular elements. At a modular scale height (Hm) of one metre, for example, all modular elements may be configured to weigh less than 50 kg, thus allowing for ease of manufacture and of installation.

Figure 1A:
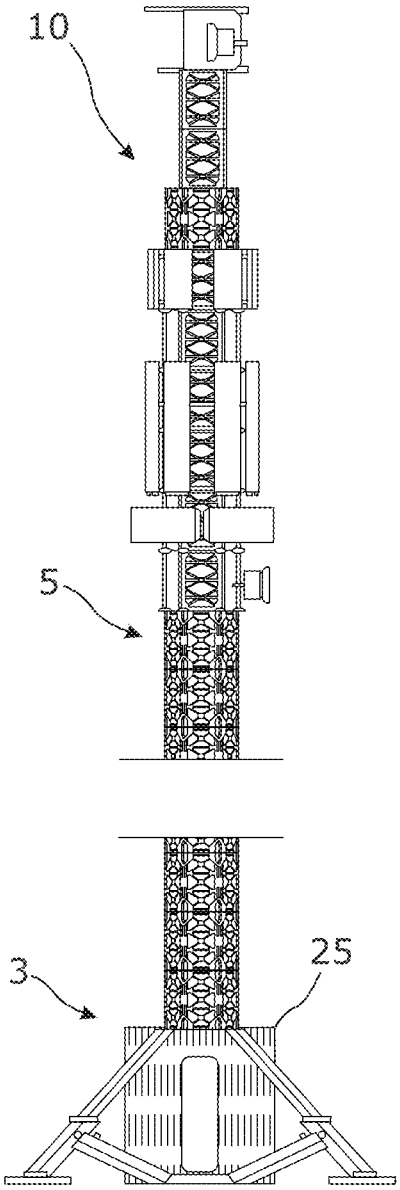
FIGS. 1A, 1B and 1C show various views of an upright structure in the form of a telecoms mast.
Figure 2B:
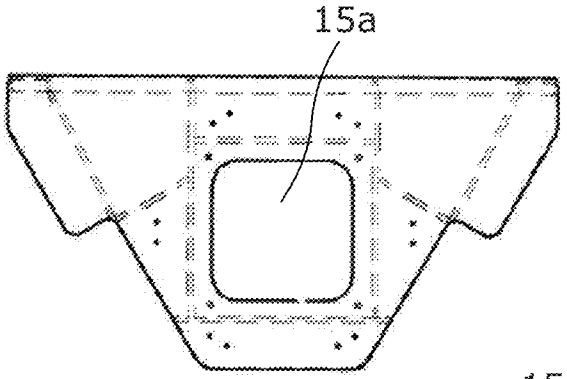
Figure 2C:
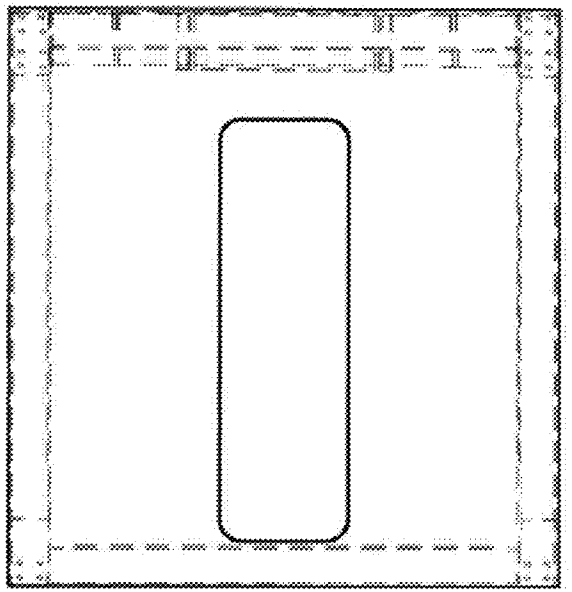
Figure 2D:
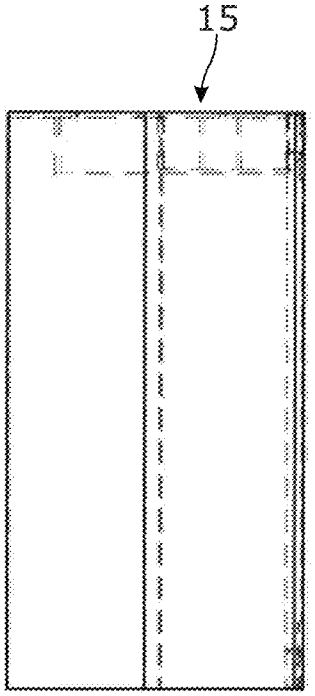
Figure 2A:
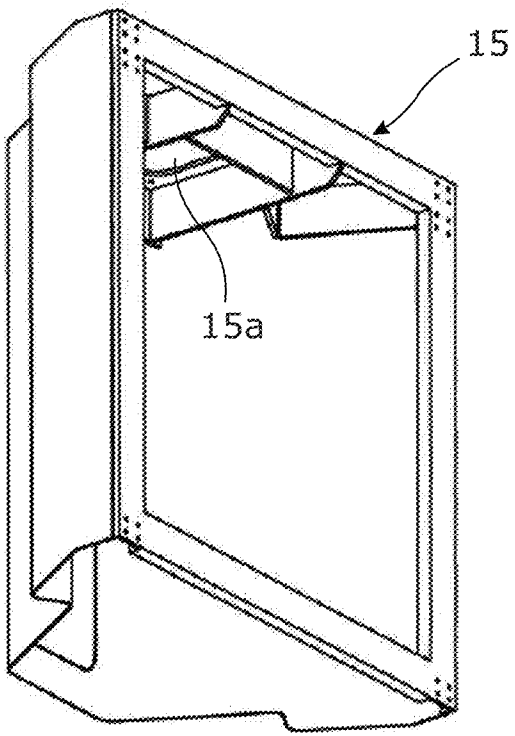
Figure 3B:
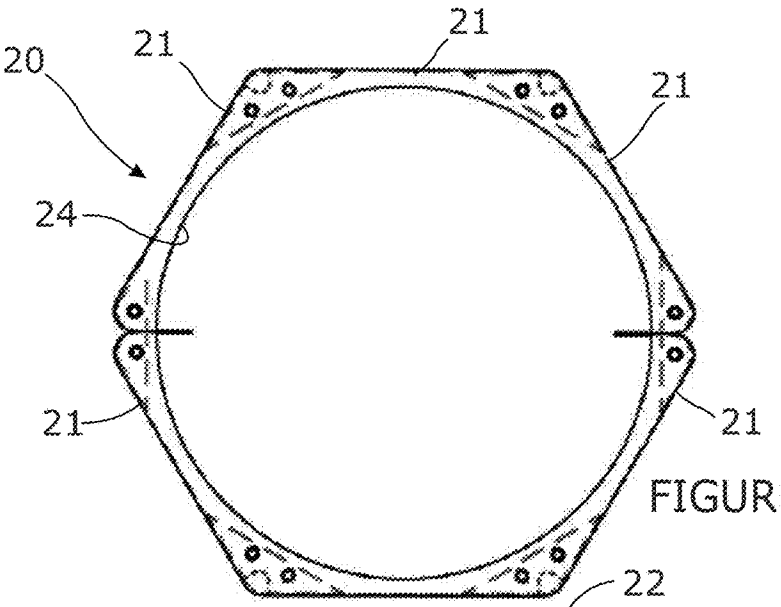
FIGS. 3A, 3B and 3C show various views of two HalfHex elements forming a Hex module arrangement.
Figure 3C:
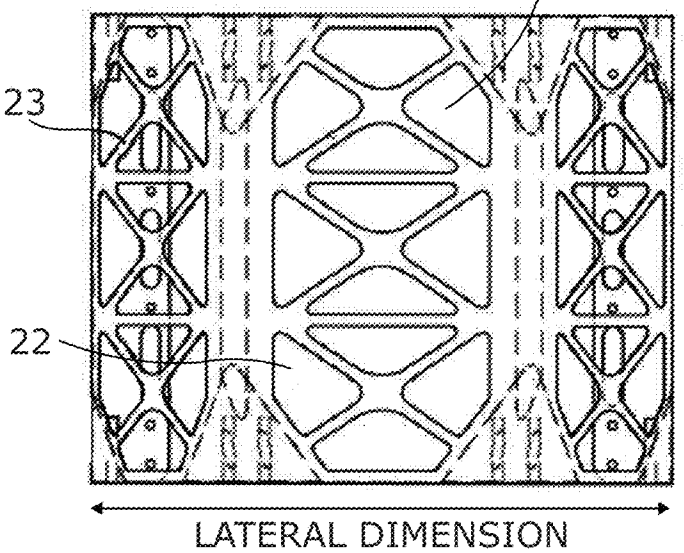
Figure 3A:
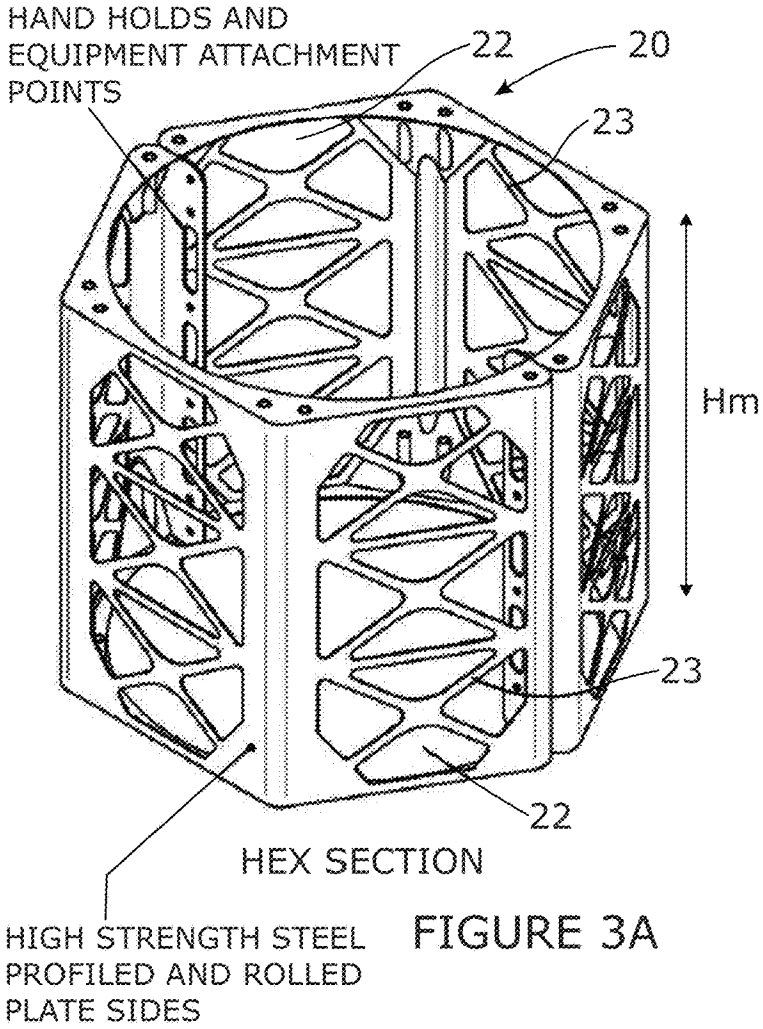

FIGS. 1*a*, 2*a* and 3*a* show a sample build of the mast system. Its modular format is comprised substantially entirely of the modular elements weighing less than 50 kg, for facilitating handling and assembly by two people. An aspect of the configuration of the elements in isolation, may not be routinely recognisable as a mast form; being of (un)characteristically low-profile or 'squat' aspect ratio for that duty. In fact the system can be seen as a type of assembly scaffold with the unique attribute of assembling to describe highly efficient vertical or horizontal structures.

Hexagonal ('Hex') modular elements (which are described in further detail below) of the mast comprise two connected half hexagon ('HalfHex') elements at every layer; the hexagonal modules are twice the strength of square section modular elements (described below) and twice the weight. The Hex and square modules are one metre high in this example, and therefore defining the modular scale Hm as 1 m (one metre), making quantifying components needed to achieve masts of certain heights extremely straightforward.

The example embodiment shown includes an ISO container 25 to which the cabin 3 is attached. The cabin is sized to couple to the end of standard shipping containers via proprietary Twistlock® compliant connectors bolted to it. The cabin 3 offers a measure of security to the base of the mast whilst allowing access for engineers to climb up and down the inside the mast. Where security is not an issue frames (i.e. cabins without outer paneling) may replace the cabin.

Modular structures, a mast in this example, need not fix to the cabin, but may be attached to any building structure, vessel, vehicle or structural foundation prepared for it. Or the entirety of a modular construction may act independent of all structural contact, i.e. set down on a surface or launched into space.

The cabin module 15 provides a (sheltered/protected) connection from the internal space of ISO container into the mast or tower. Note the aperture 15*a* shown in FIG. 2*b*, which allows someone to access the internal space of the vertical structure, mast or tower from its base.

In the example mast shown, the uppermost end of the structure has secured thereto telecoms equipment, such as transceivers, suitable for transmitting and receiving signals over an air interface. In the example this is made possible by the appropriate selection and arrangement of modular elements herein described.

Although the upright structure has been described as a mast for antennae, it also has numerous other applications, such as to support sensors in an elevated position, and/or to support a visual display or object in an elevated position, and/or be an architectural structure, which may be provided with a decorative cladding. These modular elements are specifically defined structural entities, that may be used in any way calculable.

Figure 4B:
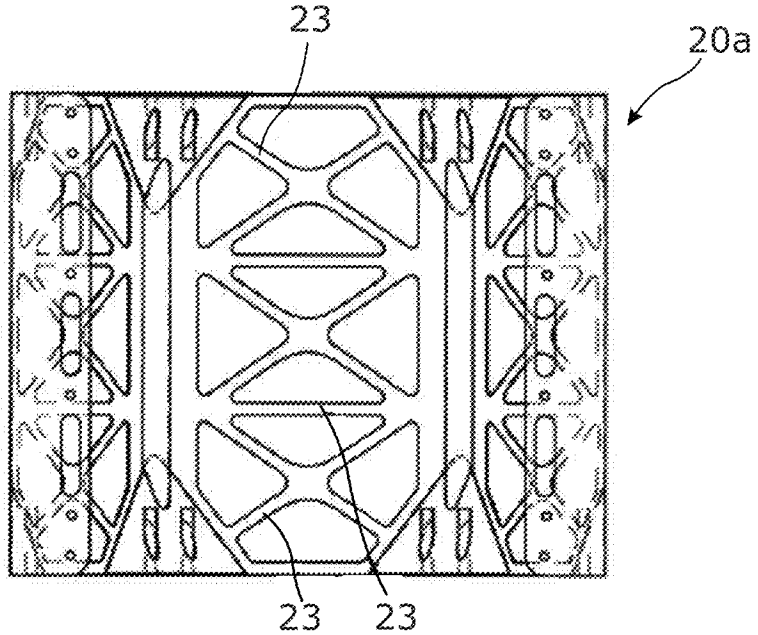
FIGS. 4A, 4B and 4C show various views a HalfHex element.
Figure 4C:
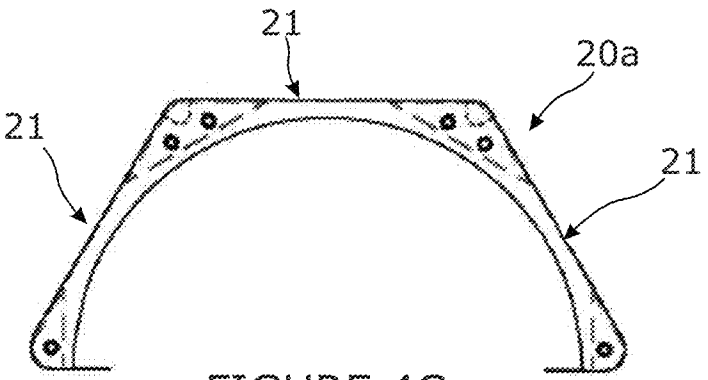

Turning to FIGS. 3*a*, 3*b* and 3*c*, the 'Hex' modular elements 20 are now described in more detail. As can be seen, each Hex modular element 20 comprises six sides 21. As the illustration shows, this element is an assembly of two HalfHexs 20*a* shown in FIG. 4, which are connected together. The element 20 has a height equal to the scaling of the overall module system Hm, and the sides ('panels') extend from one distal end to the other. Each distal end is an open distal end. The element 20 is a substantially hollow entity. Each panel here comprises a substantially planar face which is provided with a number of through apertures 22. These apertures pattern to present remaining material as a number of ribs or cross members 23, being sometimes referred to in aggregate as a lattice structure.

Upper and lower distal ends comprise an inwardly facing circular surface 24, the diameter of which is sufficient to allow a square modular element to pass) through.

As mentioned above, the Hex modular element illustrated 20 comprises two (sub-) half hexagonal modular elements 20*a*, each being of substantially half hexagonal shape (in plan), which are brought/connected together in use as a full hexagonal assembly. Each module 20*a* comprises two opposed inwardly directed flanges or interfaces 20*b*. Each flange 20*b* is provided with a number of apertures—some for allowing attachment of the two hexagonal halves together in abutting fashion and the others (at this modular scale Hm=1) for handholds to allow an operative to ascend and descend within the internal space of the structure. (It will be appreciated that in a variant the hexagonal module may be provided as a single entity formed as a unitary item, and that at other modular scales alternative means of elevation through the structure may be provided).

Figure 4A:
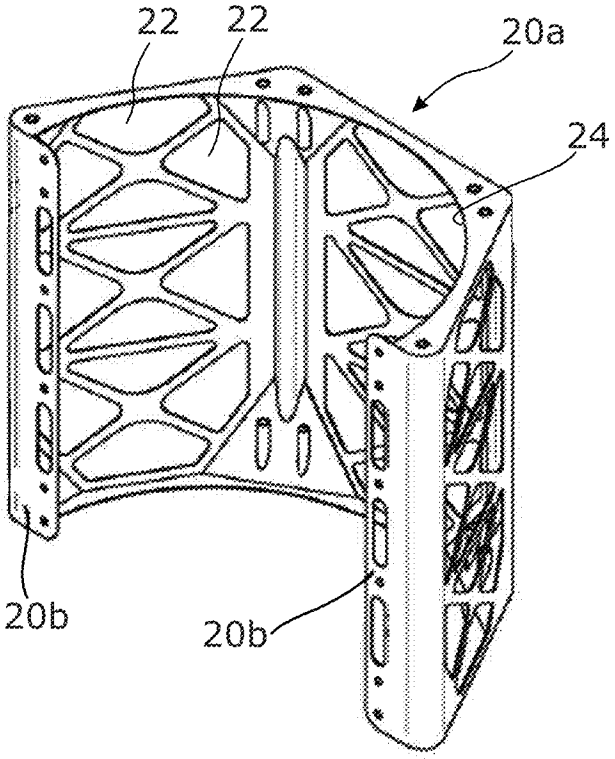

In FIG. 4*a* it can be seen that the vertical edges of the modular element 20 are formed into what may be termed as structural columns, specifically by the addition of a sloped plate through which bolting tubes are set. This feature is common with the square modular element, though at Hm=1 m the hexagonal form of the column varies additionally with either additional structure between the ends of each column, or the distinct form in way of the joint between adjacent HalfHex's.

The hexagonal modular element (formed of two connected half-hexagonal elements) and the half-hexagonal elements, have a main lateral dimension, in addition to a height dimension. This main lateral dimension is the distance between opposing corners of the hexagonal shape, as shown in FIG. 3*c*. This distance also corresponds to the diameter of its circumscribing circle, not illustrated, which is contiguous with all corners/vertices of the hexagonal shape.

For the Hex module illustrated, its lateral dimension is larger than its height dimension. The lateral dimension (or 'width' dimension) being greater than the height dimension results in a low-profile entity. Similarly, for the square element 50, its lateral dimension is close to the height. By definition the greater value of width or height is less than 1.5 times the lesser value. This thereby renders both Hex and square element devoid of 'slenderness' or geometrical representation of what they might assemble to become.

Figure 5C:
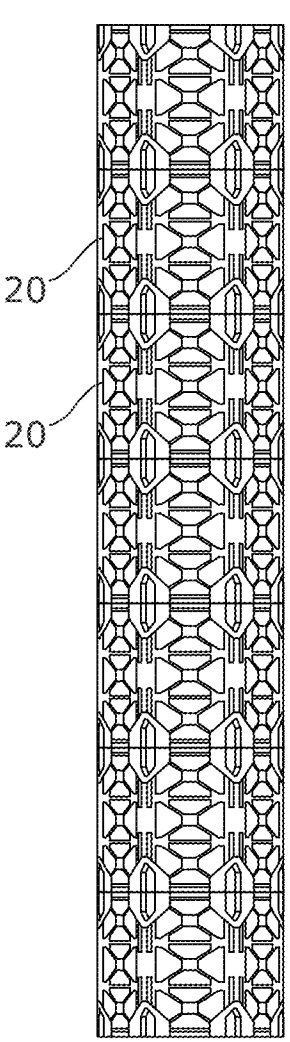
FIGS. 5A, 5B and 5C show how the Hex elements can be stacked one on top of the other to form the main body of the upright structure, and in the illustrated version with vertical joints between HalfHex modules aligned may also be arranged with such joints misaligned as stacking progresses.
Figure 5B:
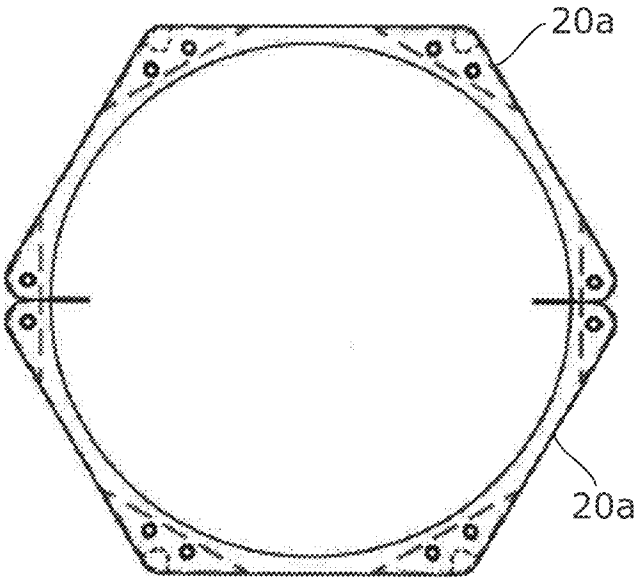
Figure 5A:
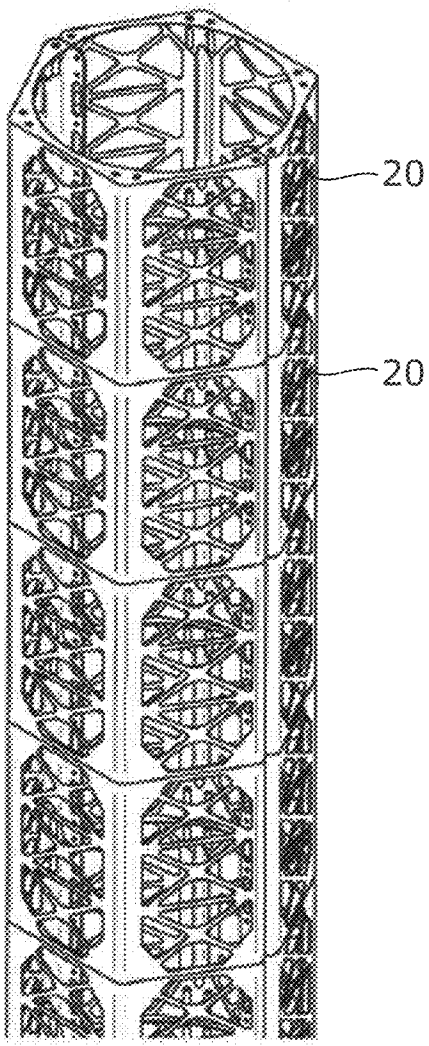

FIGS. 5*a*, 5*b* and 5*c* show how the hexagonal modular elements can be stacked one on top of the other to form the main body of the upright structure (and indeed the major proportion of the height). The illustrated example shows fully aligned stacking. However, in another arrangement the hexagonal elements may be rotated 60 degrees at additional levels to misalign the joints between pairs of HalfHex's to structural advantage.

At modular scales (Hm) up to 2 m, the vertical paneling/sides of the square modular elements and HalfHex modular elements is achieved by mechanically folding sheets of construction material. This method serves to minimise distortions due to heat during fabrication.

Figure 6:
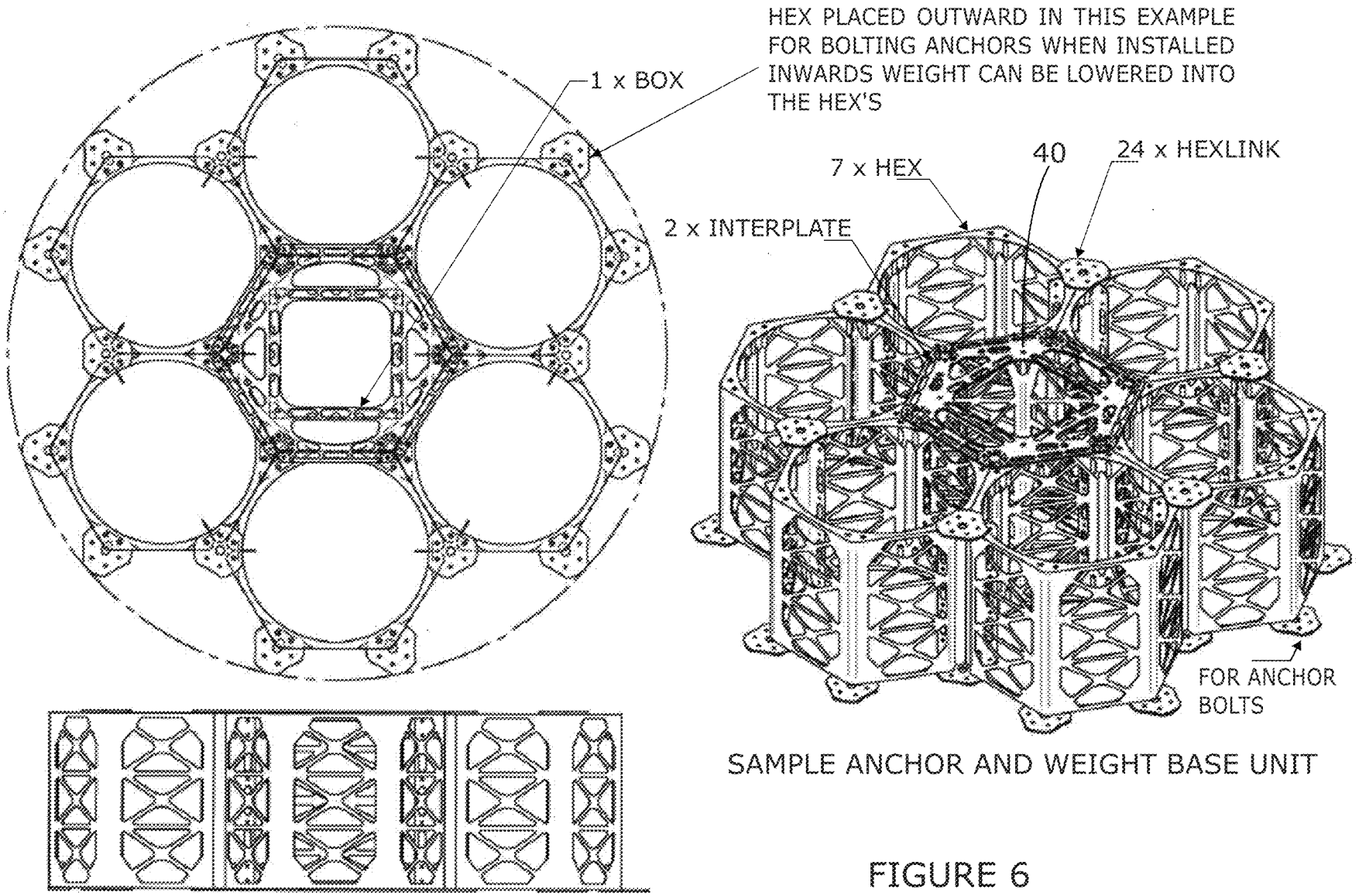

FIGS. 6 and 7 show various views of two embodiments of assembled base structures, which, in this instance, can be used to support, for example, a vertical stack of hexagonal modular elements (and any equipment attached to the top of the stack). Note how the base structures are primarily and conveniently formed of hexagonal modules or half hexagonal modules. This also includes an interplate (described further below) placed on top thereof, thereby preparing the base to interface with either square- or Hex-based vertical structures.

It may also be noted that the modular assembly in FIG. 7, presented as a base, demonstrates a versatility in that it may also be introduced higher up in a mast structure, at one or more levels, to generate increased structure for the attachment of increased amounts of equipment. In another instance the upper surface of the base structure can be provided with a suitable covering to serve as a walkway.

An aspect of the system (i.e. the use of the modules to construct the upright structure) is the relationship between two different column shapes/outlines—that of a hexagon (Hex) and that of a square. Both shapes of modular element can be attached to a foundation/base structure at the same time if need be, and thereby benefitting from the combined strength properties thereof. As can be seen in the Figures, both the hexagonal modular elements and the squared modular elements comprise profiled and formed plate exteriors with plate ends, and sloped plate and tube combinations as strong points for connection together. Advantageously, at smaller modular system scales (Hm), neither module type uses locating dowels or other locating means. This enables sections to slide across each other in the deployment from, or storing into a shipping state.

Figure 8:
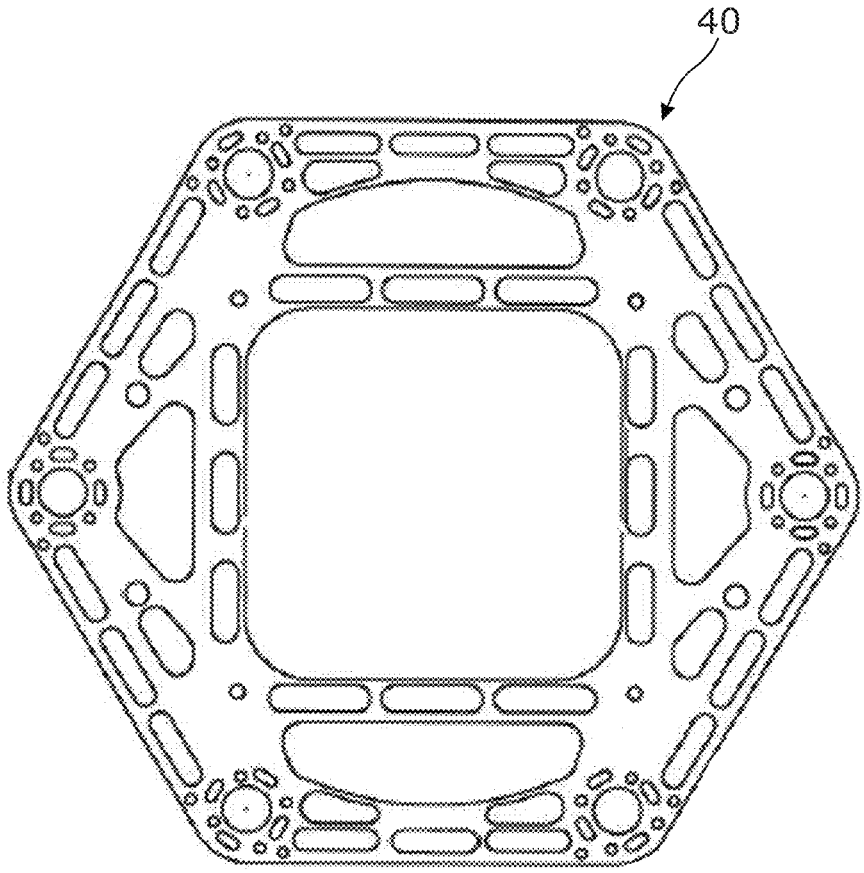
FIG. 8 shows a first view of an interpolate.
Figure 9:
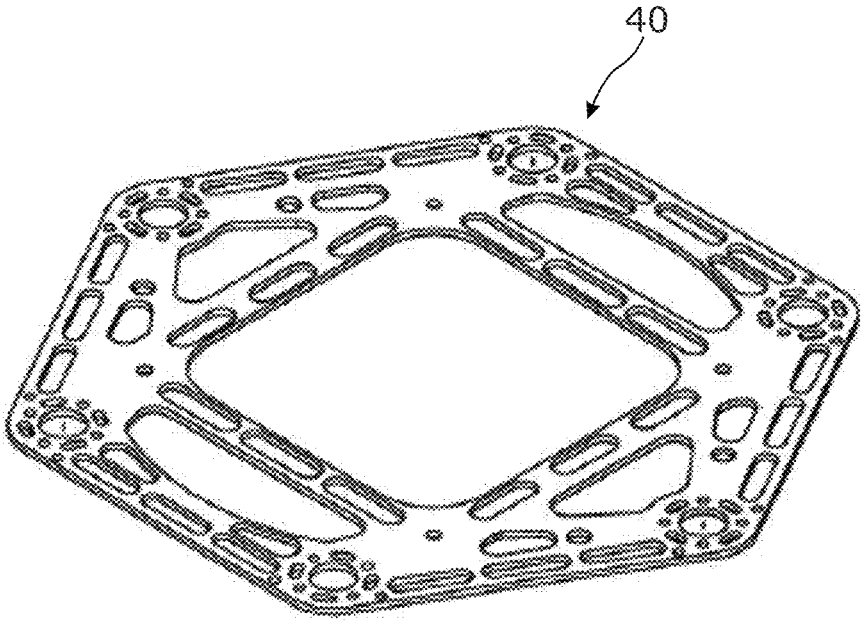
FIG. 9 shows a second view of the interplate as shown in FIG. 8.

FIGS. 8 and 9 show an interplate 40, which is of substantially planar form, and which is arranged to be secured to a distal end of a modular structural element. This is essentially a connection component and/or support component, which comprises multiple attachment or bolting positions to allow for modular structural elements to be connected together to create an assembled structure, and also allows for structural change as the structures develop. The interplate 40 is provided with various apertures as shown. In FIG. 8, it can be appreciated that the aperture pattern provides for the fixture of six poles, each with four bolt flanges, positioned at the corner regions of the hexagon shape of the interplate, whilst, inwardly thereof, there is defined a (central) squared aperture and outlying said central squared aperture are four corner bolt positions are provided that a square modular element attaches to or can extend through. It is then of note that the half-hexagon and hexagon modular elements can attach to or through each of the inner two pole flange holes at each of the six corners of the hexagon shape.

The interplate 40 is of a thickness equal to that of a link plate (or HexLink). In this way interplates and link plates can be arranged in link layers of the modular structural elements such that they are sandwiched between adjacent square and hexagonal structural layers.

Figure 10:
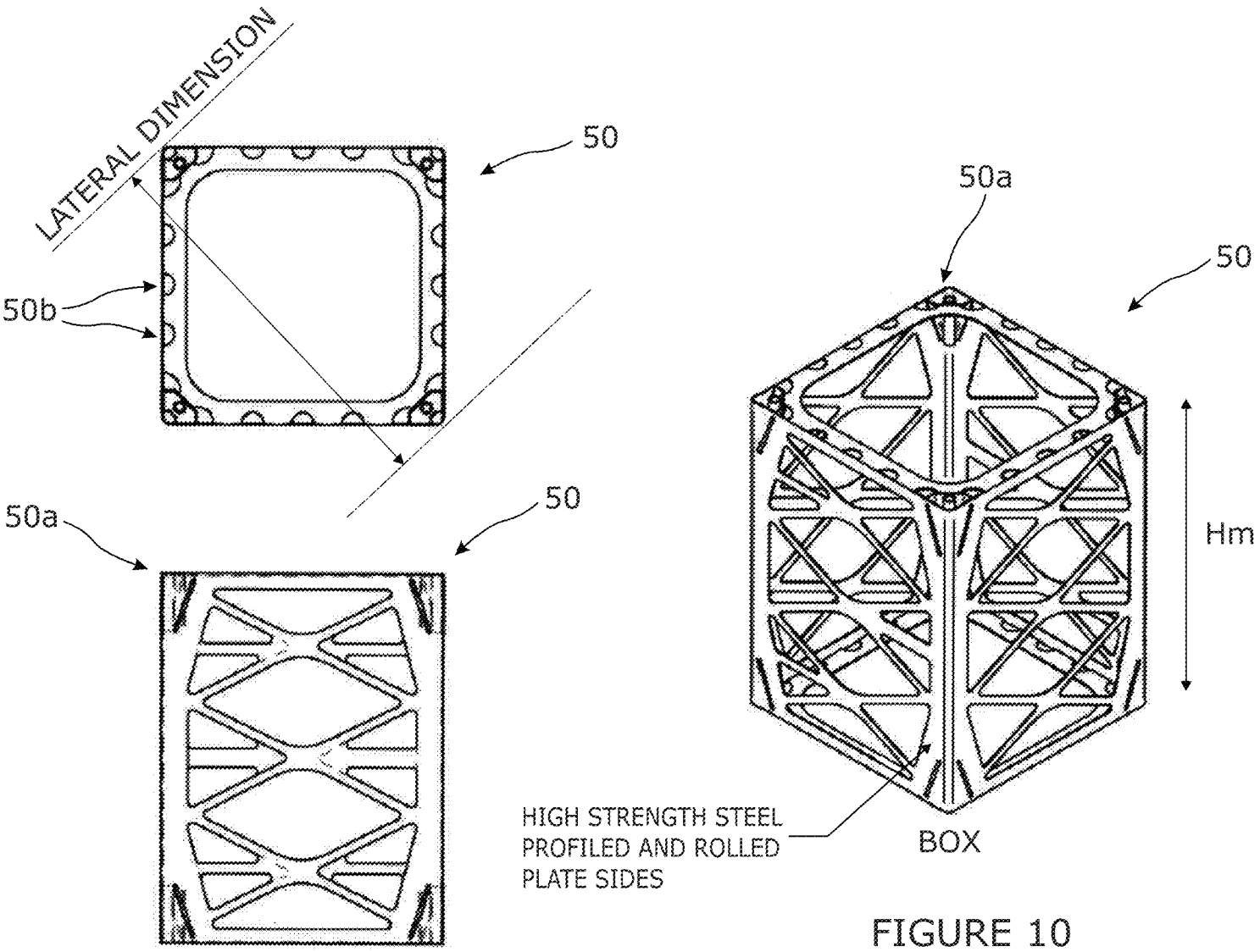
FIG. 10 shows three views of a square section element.

The square modular element is shown in FIG. 10. It shares some similarity in construction with the HalfHex modular element (e.g. the profiled panels), and is also an open-ended component, however the square modular element is of squared rectilinear transverse sectional shape. The illustrated element may be of module system scale of 1 m. These modular elements may not only be optimised to weigh less than 50 kg each, but the square modular element is especially configured for construction from very high strength steels whilst retaining dimensional stability. Of particular note in this regard, shown generally at 50*a*, are the folds in the sloped corner plates, that allow the plates to be projected through the panels to be welded from outside the module. The distal end panels too, also feature semi-circular cut-outs 50*b* which limit weld content to the panel edges; thereby conserving dimensional accuracy.

The main lateral dimension of the square modular element 50 is measured as the distance between opposing corners of the square outline, as shown in FIG. 10. As will described below, the main lateral dimension of the square modular element 50 is inferior to that of the lateral dimension of hexagonal modular element 20. It will be appreciated that in some instances it may be more suitable or appropriate to determine the main lateral dimension as being the wide of a side of the element.

Figure 11:
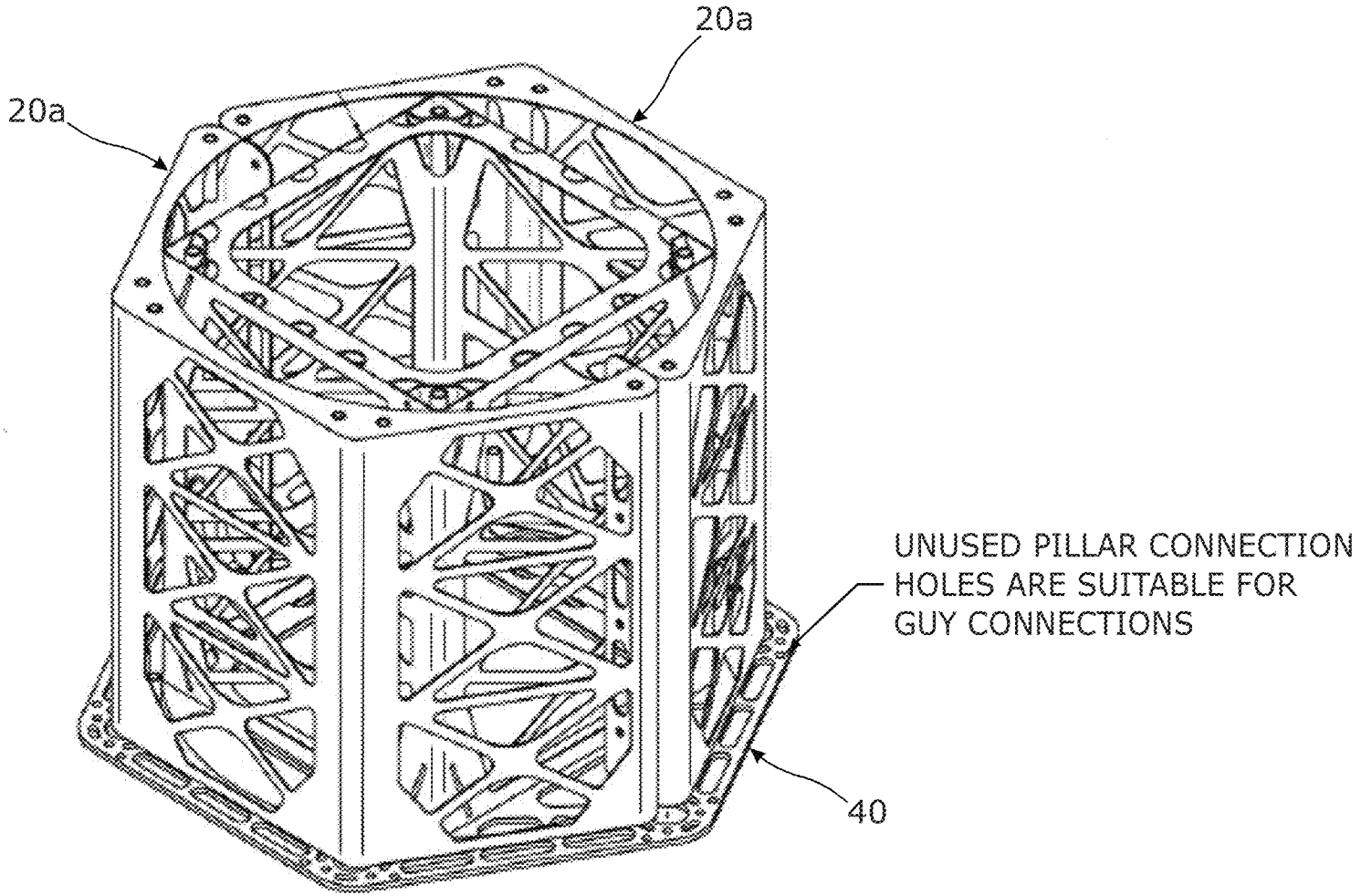
FIG. 11 shows a Hex with a square section element inside and both mounted onto an interplate.

FIG. 11 shows how the hexagonal module is dimensioned to fit around the outside of the square modular element 50. By this feature, higher sections of masts that include square modular elements, transition, through the use of interplates 40, at two or three intersections into hexagonal modular elements only, for increased strength lower down. And, as loads build with increasing mast height above a section, even the hexagonal modular elements can become structurally overwhelmed, so that the interplates and square modular elements are introduced again, now at every level, for the maximum strength available within the boundary of the interplate profile.

Figure 1B:
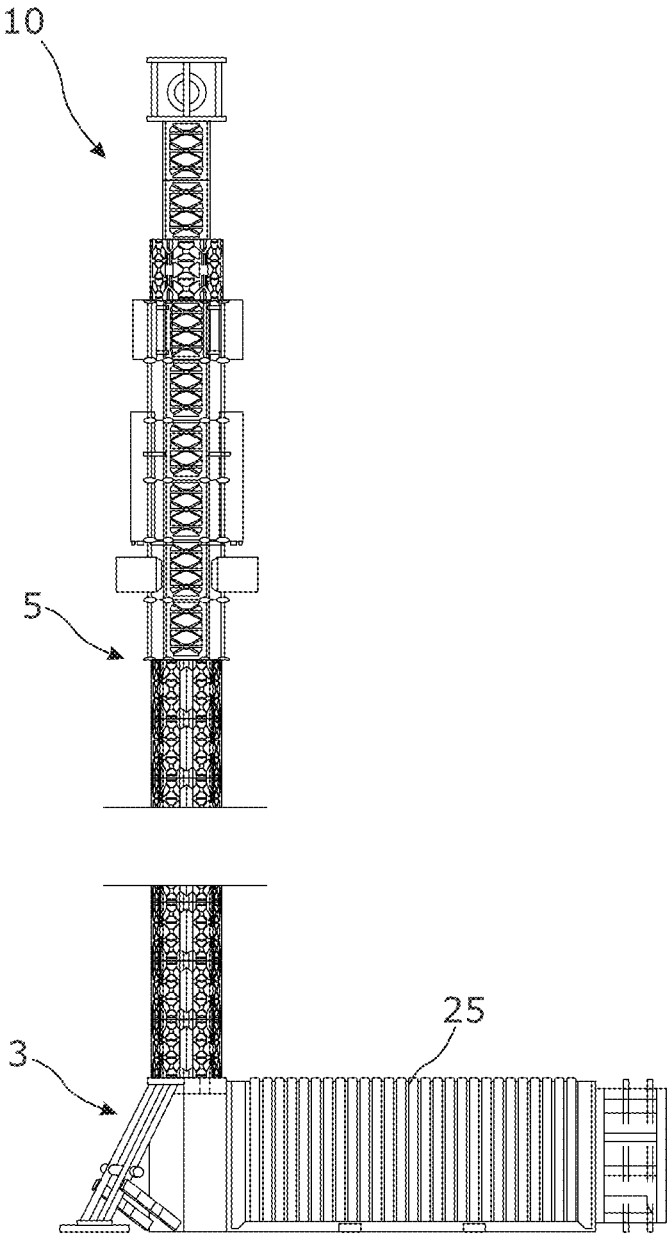
Figure 1C:
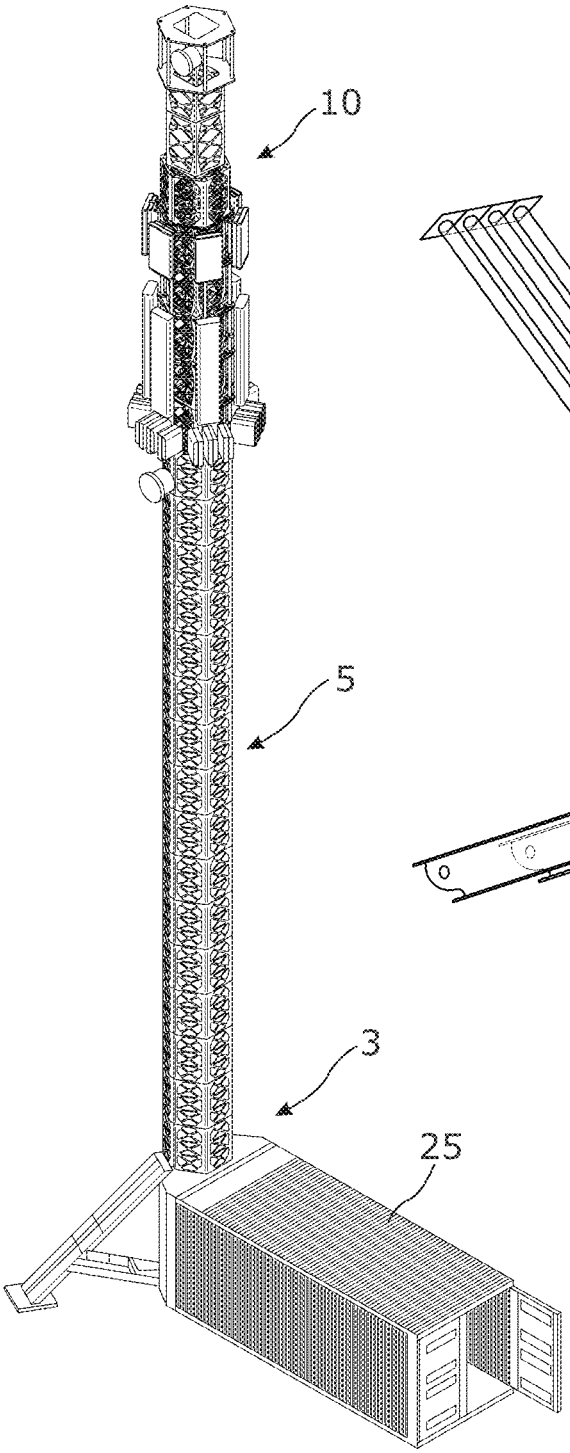
Figure 1D:
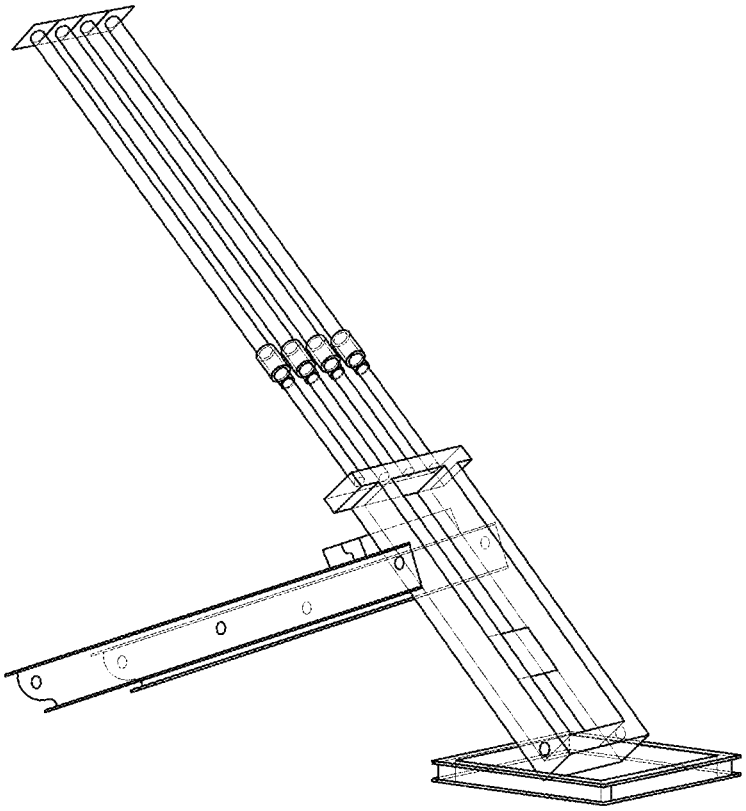
FIG. 1D is a detailed view of bracing used with the mast of FIGS. 1A, 1B and 1C, FIGS. 2A, 2B, 2C and 2D show various views of the cabin which is shown in FIGS. 1A, 1B and 1C, which connects the end of standard ISO containers via the container's TwistLock® system only and forms the structural foundation for the mast.

With reference to the upright structure shown in FIGS. 1A to 1C this has a lower portion which comprises multiple hexagonal modular elements located one above the other and an uppermost portion which comprises multiple square modular elements arranged one above the other in a vertical direction. Moreover, the lowermost portion has no (i.e. is devoid of) square modular elements, and the uppermost portion has no hexagonal modular elements. However, at a region between the upper portion and the lower portion, one or more of the square modular elements are located inside the hexagonal modular elements, in what may be termed as a transitional portion of the structure.

Figure 12:
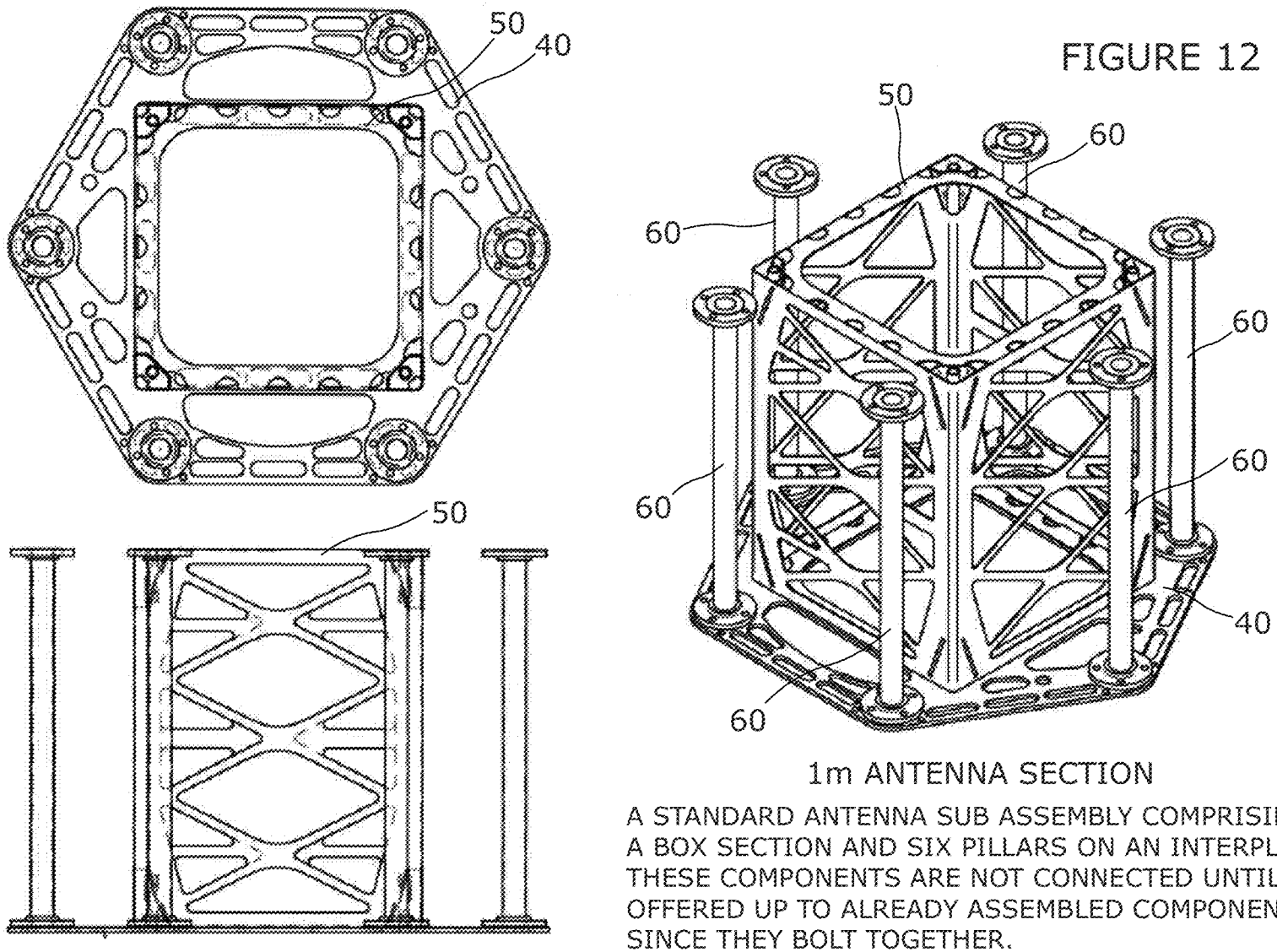
FIG. 12 shows a square section element and six poles mounted onto an interpolate.

FIG. 12 demonstrates a particular modular configuration where modular poles 60 are positionally set by the interplate around the stabilising square modular element core. This arrangement can be set in isolation with the length of a square section mast, where an uppermost interplate would secure the tops of the poles, or continue for many layers. The poles are devised, at the illustrated module scale, for fixture of telecoms equipment, as illustrated here, and similar.

When, in particular, the configuration set of in FIG. 12 is set down upon a combined hexagonal and square substructure (FIG. 11), structural load bearing on the square modular element(s) bear down on the square element(s) beneath, whereas loads on the poles bear down through to the columns formed of hexagonal modular elements. In this way, also, potentially damaging load concentration developed at sharp changes of section (an engineering constant) are diffused.

Figure 14:
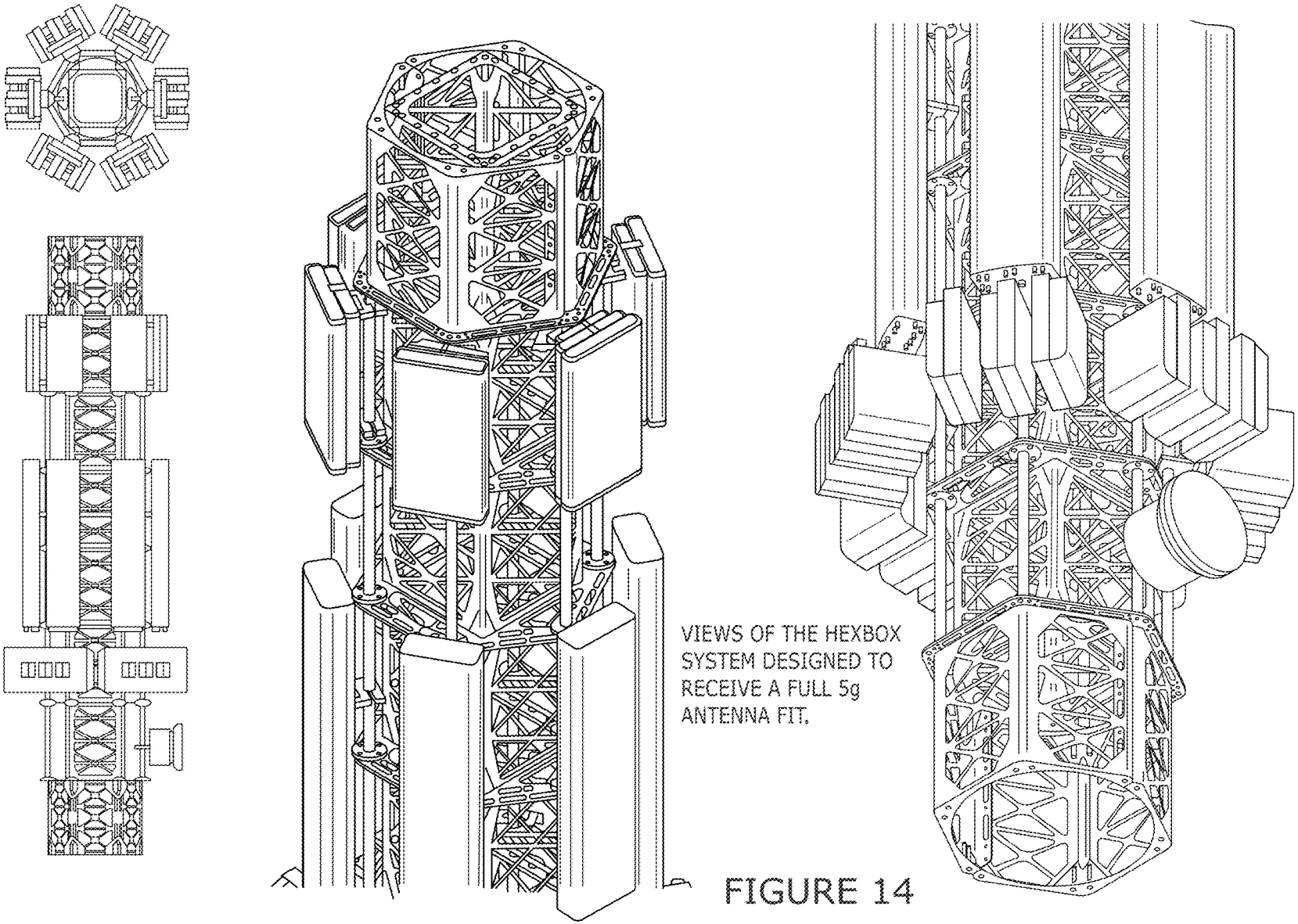
FIG. 14 shows a complex example of various items of telecommunications equipment mounted to an eight level stack comprised of square section elements, HalfHexs, interplates and poles, in which such a sub-assembly may be lifted to a mast top by crane.
Figure 16:
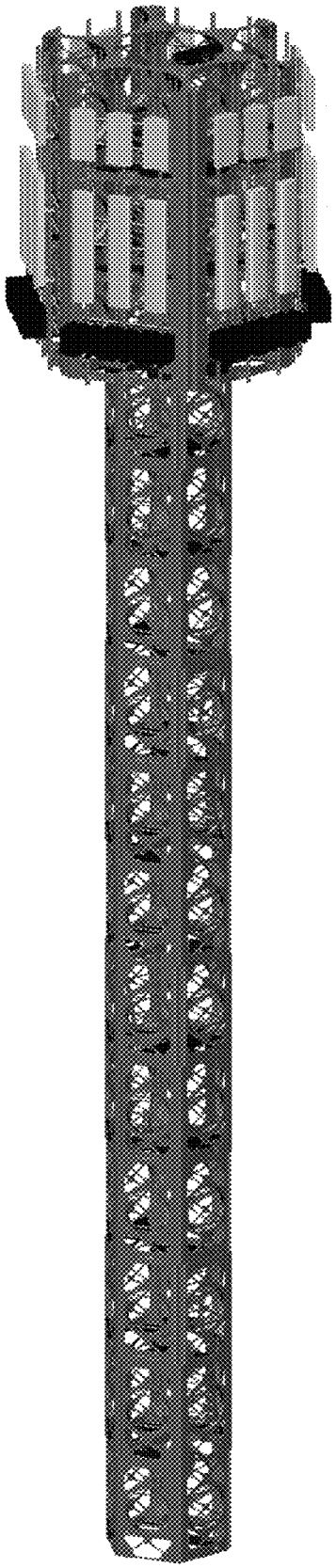
FIG. 16 shows a mast as would be fastened to a pre-prepared foundation which is of Hex form complete with internal ladder way to the top, and which also shows lateral construction in the upper layer, facilitating the installation of greater amounts of the equipment shown in FIG. 14.
Figure 17:
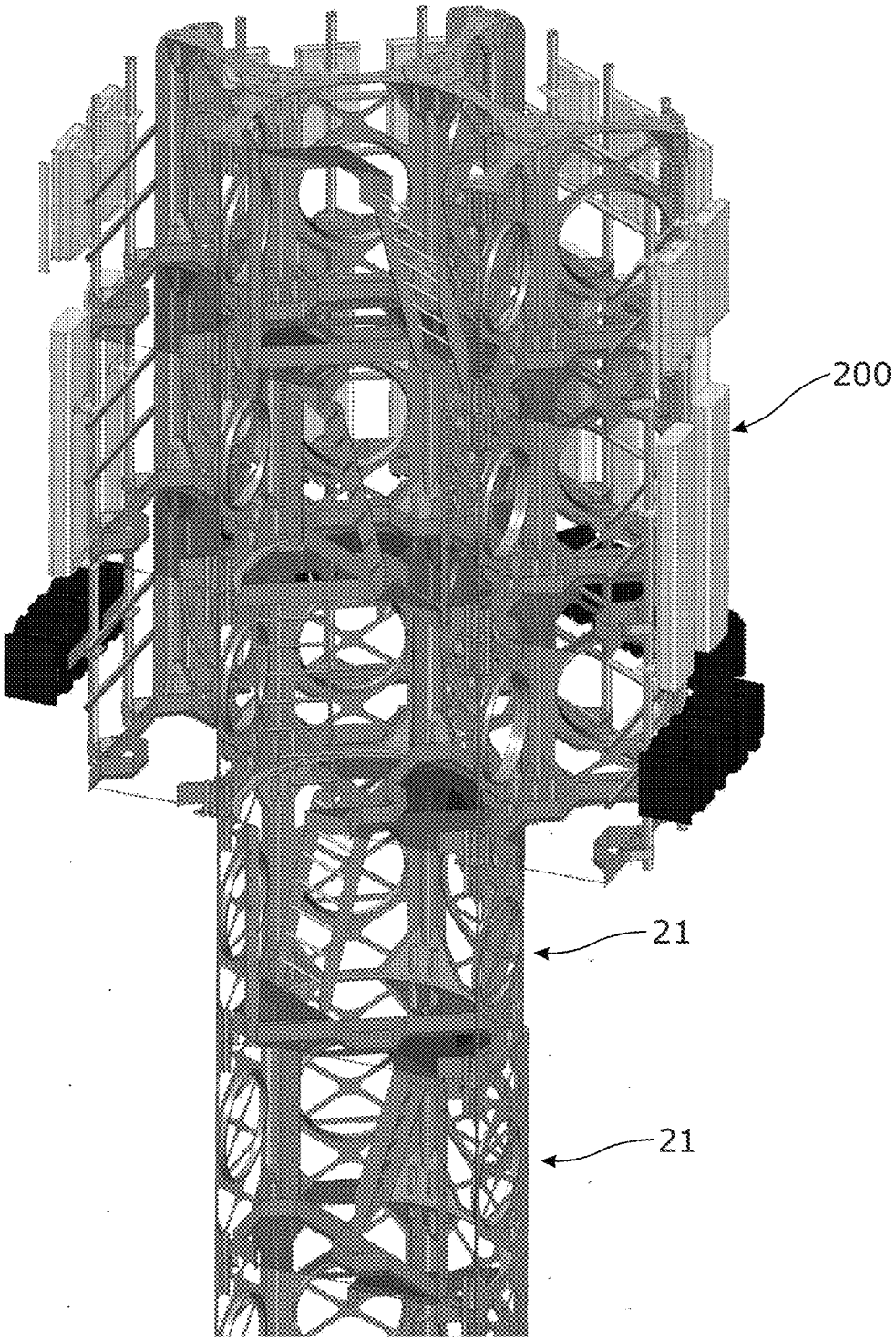
FIG. 17 shows a cutaway view of the upper sections of FIG. 16, in which link plates are seen to join six HalfHexs around a central Hex at three levels, thereby constructing a large, three level platform area with people able to move laterally through cut open panel access holes.
Figure 18:
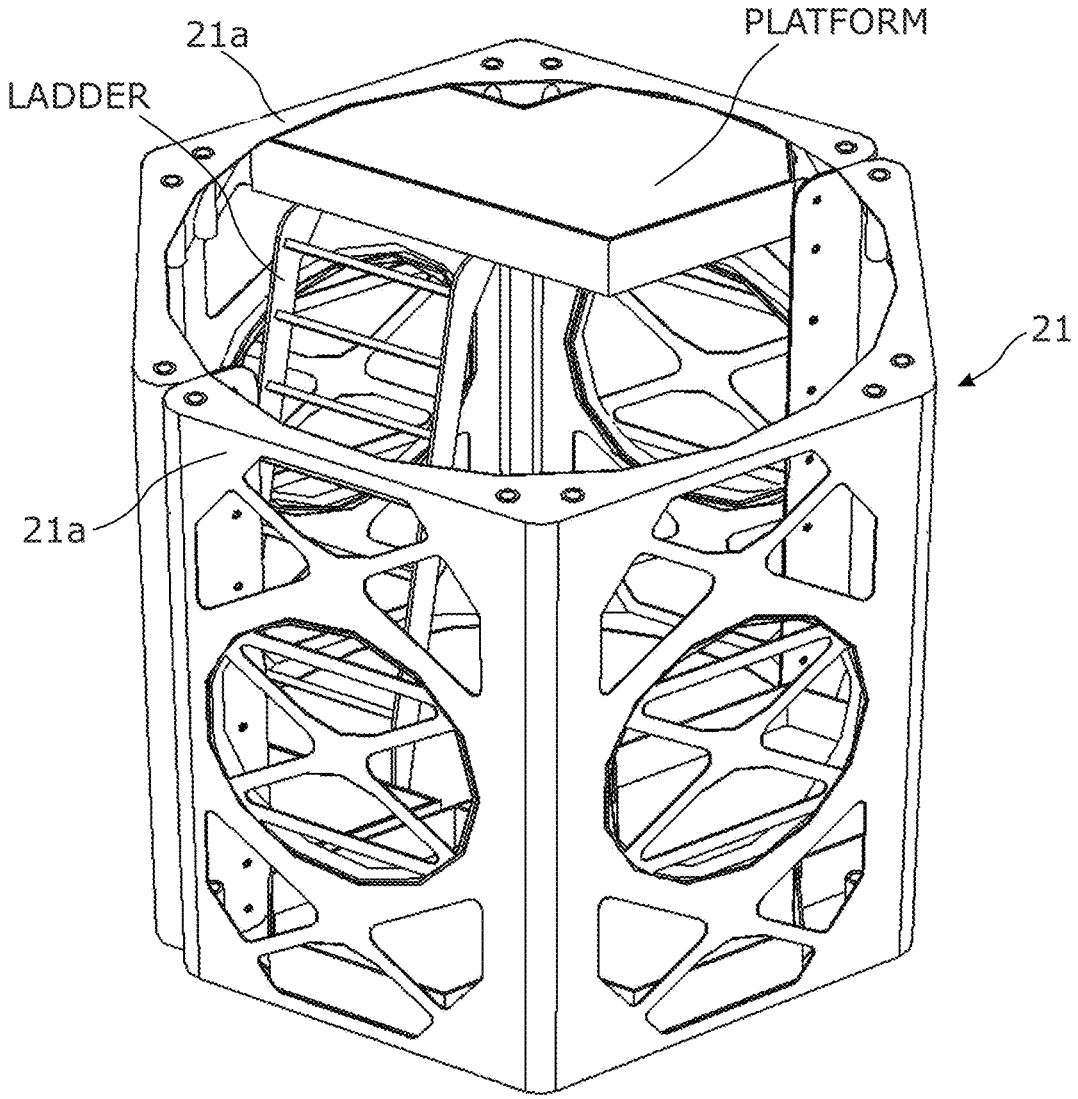
FIG. 18 shows a Hex complete with secondary ladderway structure.

FIGS. 13 and 14 show a configuration in the provision of a single microwave dish (FIG. 13), and a full 5G telecoms installation (FIG. 14). In the latter case, the entire content illustrated in FIG. 14 is demonstration of a complete sub-assembly that can be assembled horizontally on the ground, to be raised to the vertical and up onto the mast in a single, fully tested and operating unit.

FIG. 15 shows a variant embodiment 50*a* of a square modular element 50, in which a ladder is provided within the internal space. As is also shown in FIG. 15, a number of such elements are stacked and are relatively orientated so that a person can ascend and descend using the respective ladders within the internal space collectively defined by the elements.

Figure 19:
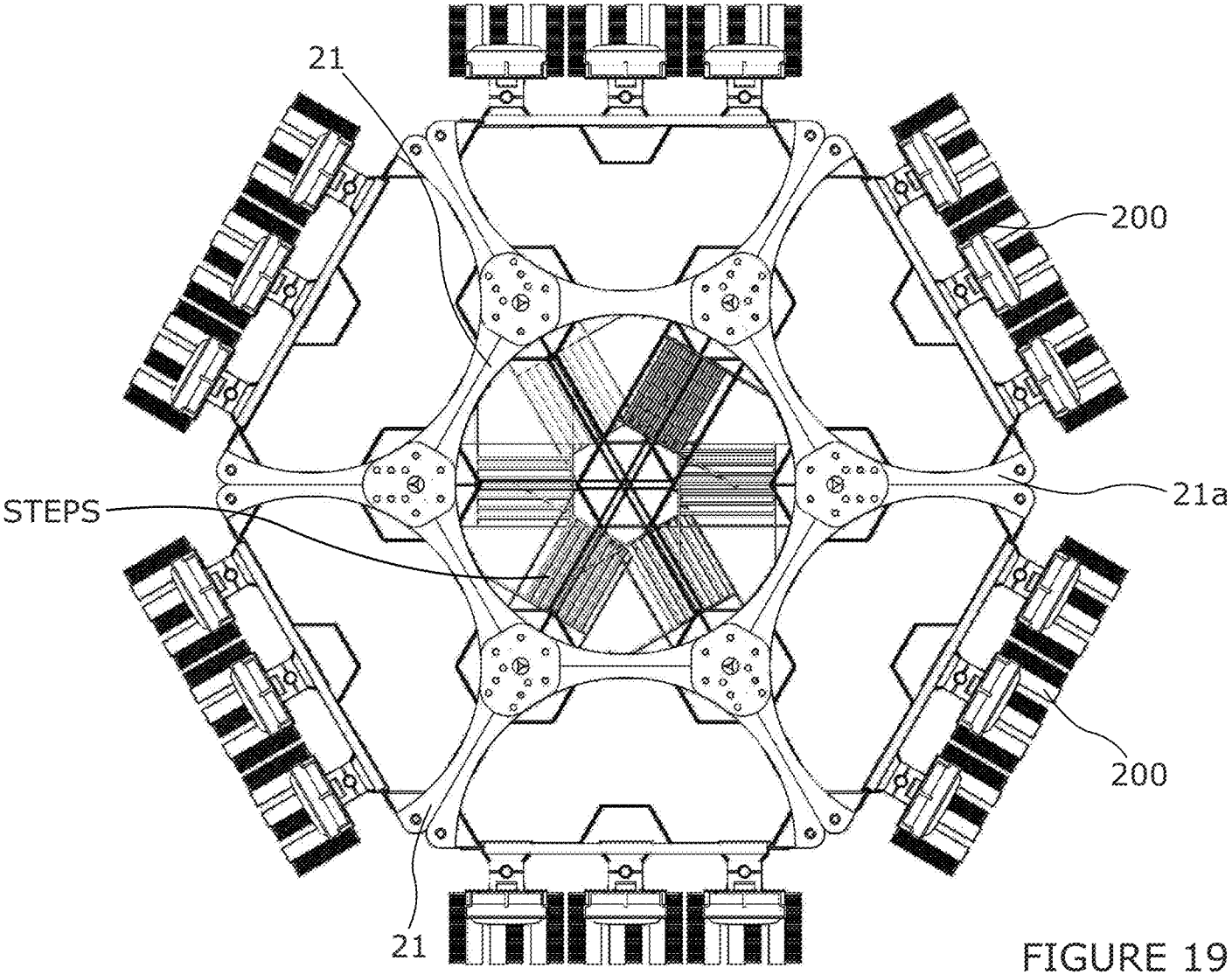
FIG. 19 shows a plan of FIG. 16 in which link plates secure an additional ring of HalfHexs, with the central ladderway is shown surrounded by walkways, and wherein gaps down through all structural elements present as cabling routes.

FIGS. 16 to 19 show a mast structure for cellular network telecommunications equipment 200 which mast structure comprises a vertical stack of hexagonal modular structural elements 21, formed of two connected half hexagonal modules 21*a*. (The elements 21 may be of Hm=2 m.) The modular elements 21 are variant embodiments of those (hexagonal elements 20) described above, which are formed of two connected halfhex elements, in which one of the halfhex parts comprises a ladder and a platform, and the other halfhex which is attached thereto is devoid of those features. The ladders and platforms advantageously provide access to a service engineer to ascend the internal space of the mast using the steps and perform any necessary work on the telecommunications equipment. FIG. 19 shows a plan view of the mast. As can be seen a number of halfhex elements (i.e. those without the ladder and platform) have been attached to the outer panels of the uppermost hexagonal modular element of the mast head sub-assembly, to provide a support structure for the telecommunications equipment.

Figure 20:
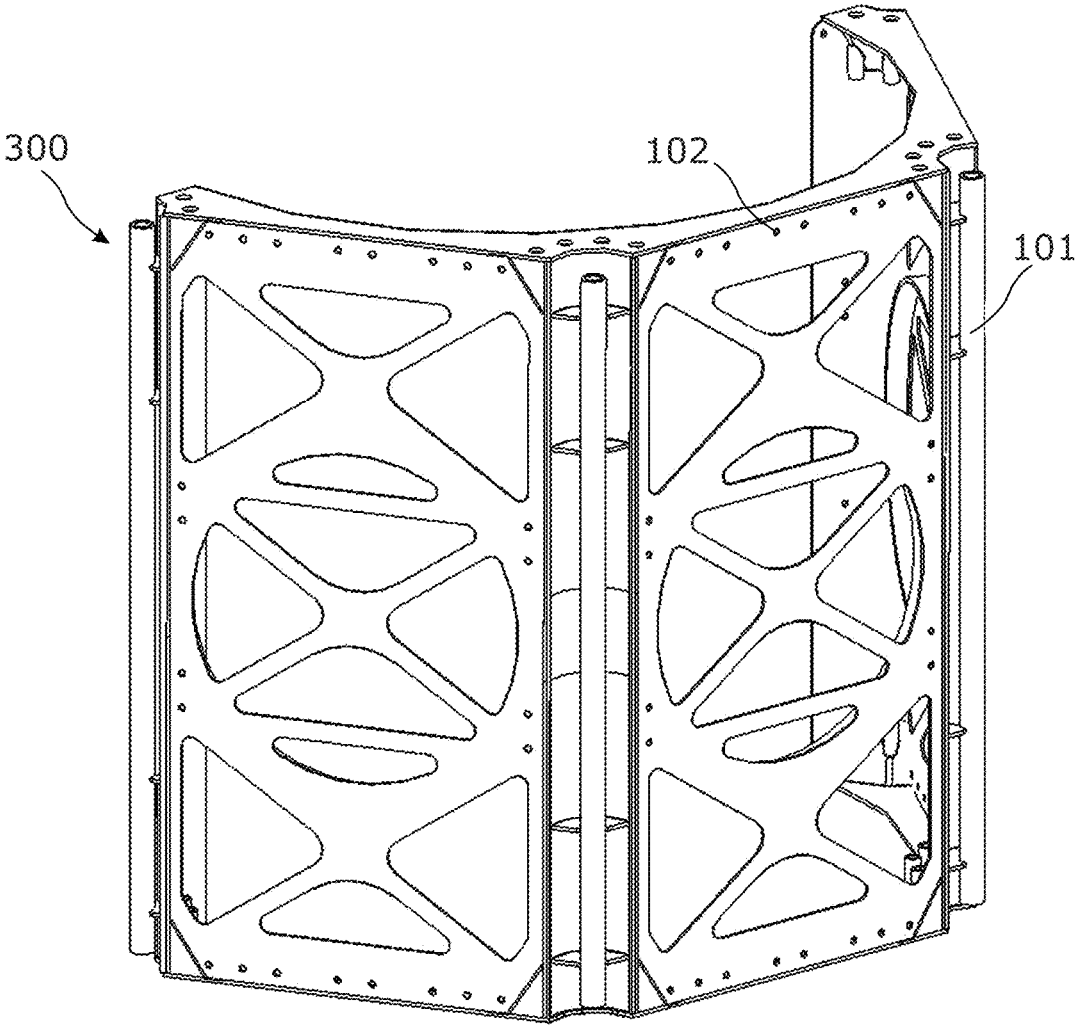
FIG. 20 shows a derivation of a HalfHex element with a (standard) panel used on both HalfHex and square section element in the variant shown.

FIG. 20 shows a variant half hexagonal element 300 (which may be combined with another like element) with common sides/panels throughout, thus enabling lateral (side-by-side) connection with another such element by the addition of extra fastening holes 102 and suitable fasteners. Since the panels close with the corner structure but not panel to panel, a recess is formed at the corner into which a utility post 101 is provided. These posts, being similar to the poles 60, conveniently expand opportunities for fitment of equipment and lifting points.

Figure 21:
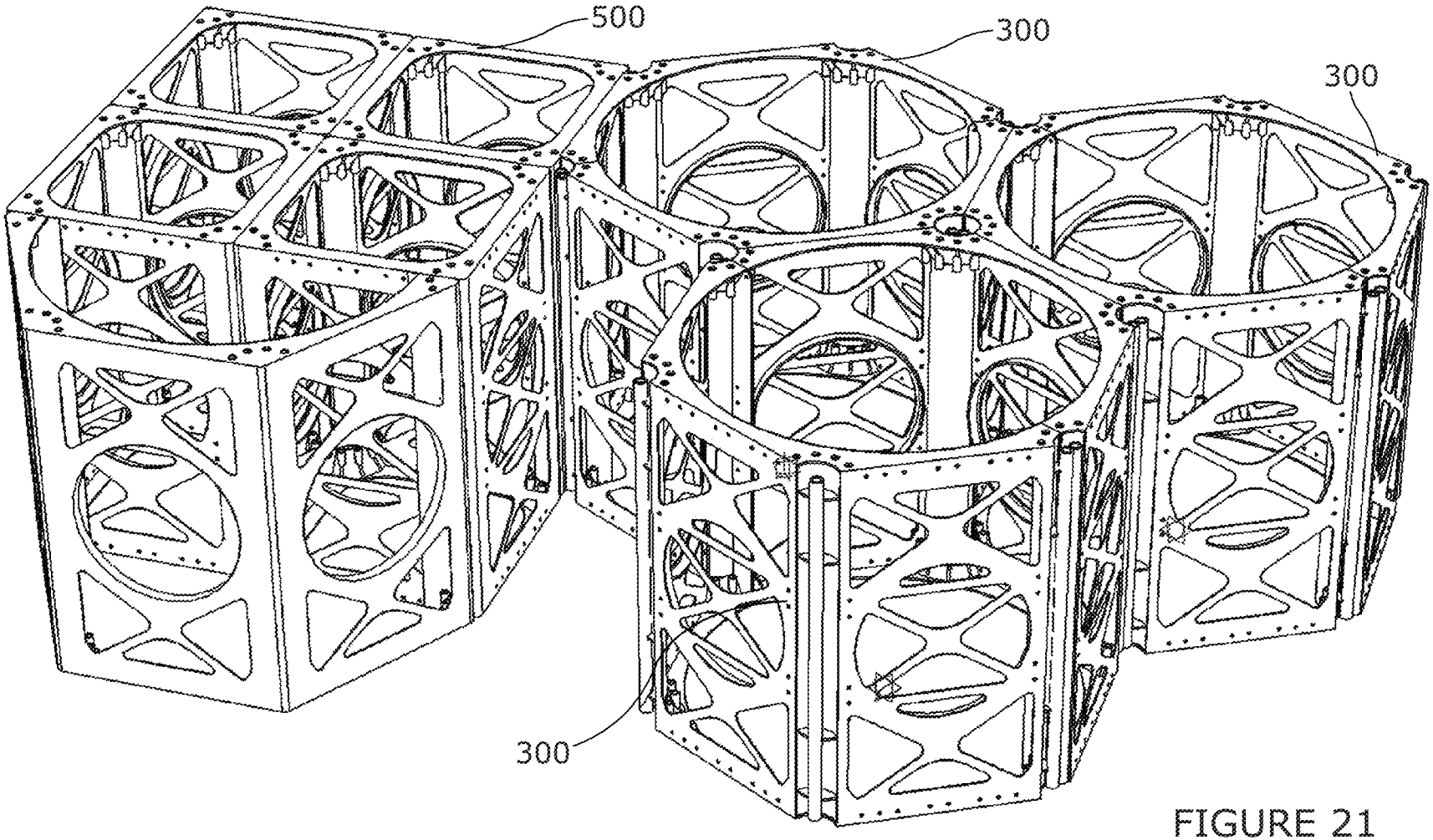
FIG. 21 shows a possible realisation of lateral assembly of modular structural elements.

FIG. 21 shows a lateral arrangement of a number of modular structural elements (which may be of Hm=2 m) which are connected together (and may for example form part of a base structure). The arrangement shown includes several hexagonal elements 300, as well as a square section element 500. The size and shape of the panels/sides of the elements 500 matches those of the sides/panels of the hexagonal elements, allowing the two different varieties of elements to be interfaced together.

Although for the above described embodiments of the modular structural elements the sides/panels are open (or more precisely, apertured), in other embodiments some or all of these panels/sides of an element may be obfuscated or blocked or covered with material components such as sheets or planar materials (which may be opaque, transparent or translucent). In some embodiments, the modular structural elements may be formed as having closed sides/panels, at the time of manufacture, as compared to retrofitting procedure to cover/close the one or more sides.

Further in addition to the embodiments disclosed above, the modular structural elements may be of a triangular section. For example, such an element may have three sides/panels which are each of a size and shape which substantially match those of the elements shown in FIG. 21, and are therefore interfaceable therewith.

Figure 22:
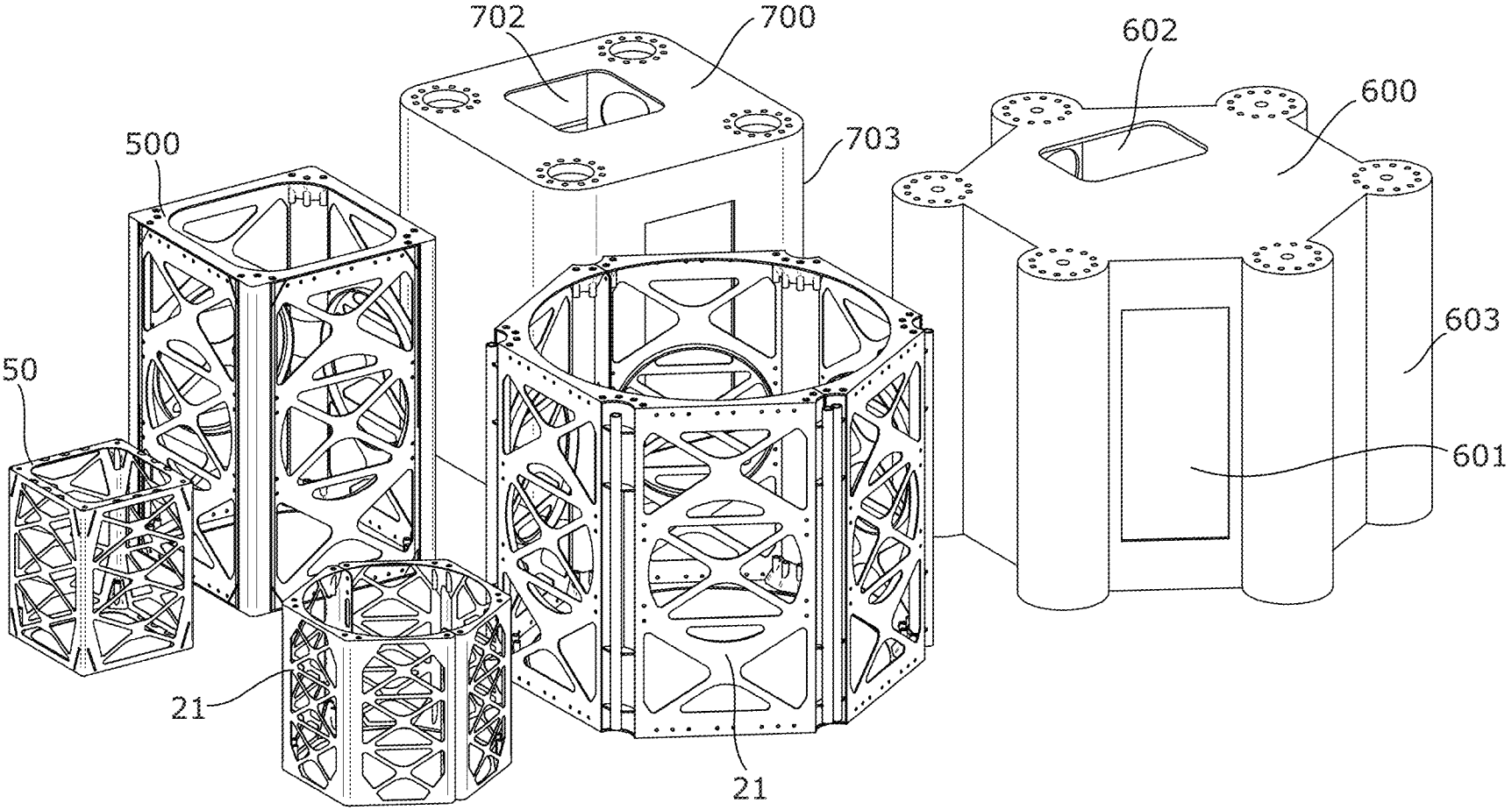
FIG. 22 shows a perspective view of various modular structural elements.

Reference is made to FIG. 22 which shows an array of some of the modular elements described above, but also including two further modular structural elements, 600 and 700, which may both be of modular height Hm=2 m. The modular structural element 700 may be termed a fort, and has four orthogonal sides. Three of the sides are solid and not apertured. One of the sides is provided with an opening 701, which allows humans to access the internal space defined by the element. The four corner regions 701 of the element 700 are rounded by virtue of the element containing four corner columns 703. The bolting patterns at the opposite ends of these columns match those described by the square and hexagonal modules when laterally assembled to generate a complete bolting circle (as visible in FIG. 21). These reinforcing elements 703 are hollow and are located internally of the element in the square form. An uppermost surface (or roof structure) of the element 700 is provided with an aperture 702.

The element 600 which may be termed a castle, is likewise of a reinforced nature, and has access opening 601 in a side, and an uppermost access aperture 602. However, the element 600 matches geometrically the hexagonal cross-section as the hex module 300. A (protruding) corner column 603 is provided along the apexes between adjacent sides, with bolt circles arranged at their ends in positions matching positions in the Hex 300.

Figure 23:
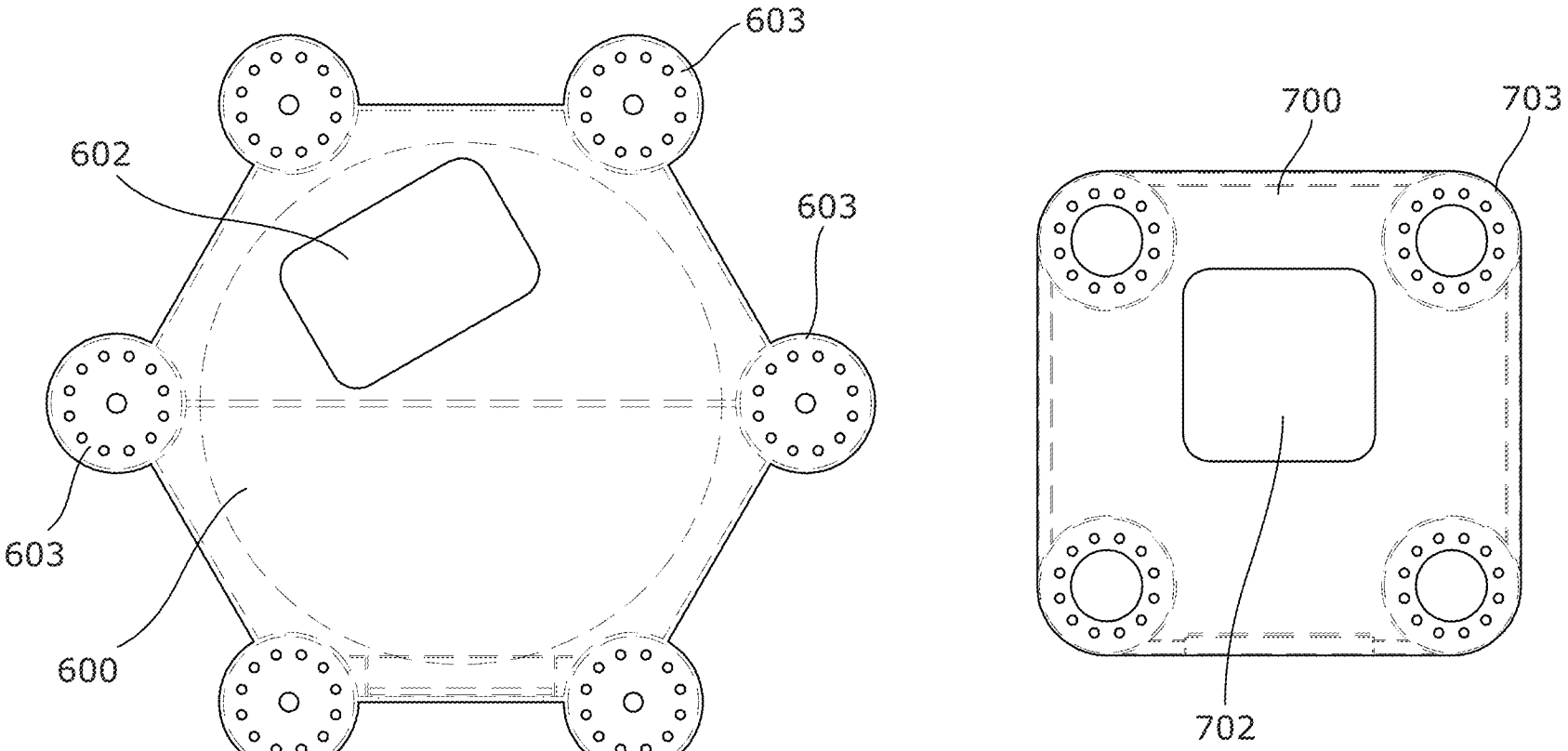
FIG. 23 shows plan views of two of the elements in FIG. 22.

FIG. 23 shows the plan views of the six-sided castle element and the four-sided fort element. For both elements, the distance between one tubular column and an adjacent column is the same. Whilst the interlinking side panels on the castle 600 match the positions of the sides on the Hex 300, the positions of the panels on the fort element do not match the panel positions on the module 500, but instead they align tangentially to the exterior of the corner columns to maximise available internal space.

Figure 24:
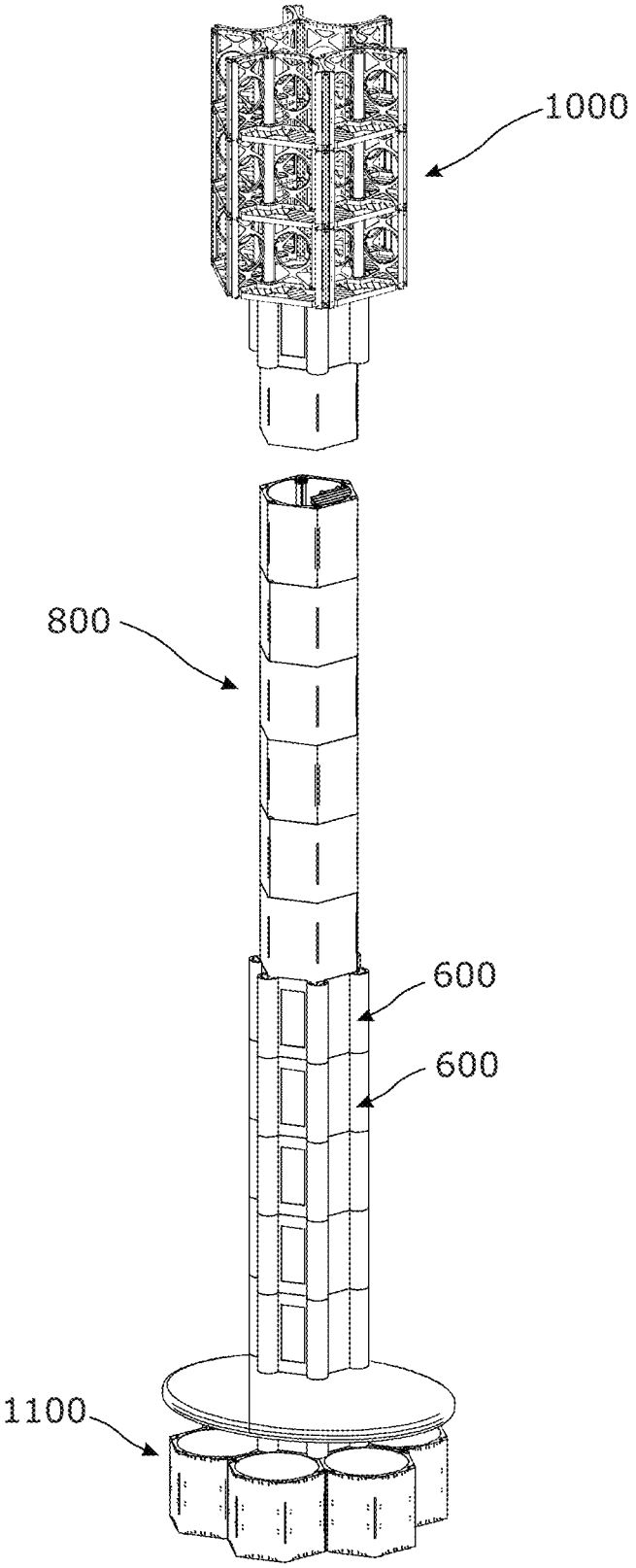
FIG. 24 shows an antenna mast structure (in an exploded view) which includes the use of elements shown in FIG. 23.

FIG. 24 shows one possible embodiment of the way in which the elements 600 can be combined in a mast structure. At the top of the mast structure there is provided an antenna head 1000. Below the antenna head there is provided a vertical stack of hexagonal elements 800. These hexagonal elements may be viewed as variant embodiments to the hexagonal elements 300 in which the sides are provided with solid paneling to cover the apertured open sides. This provides for enhanced security and weather tolerance. Below the elements 800, there is provided a plurality of stacked elements 600.

A base 1100 is provided which comprises a plurality of solid sided and based versions of hexagonal elements 800 connected laterally, and which contain weight to assist in maintaining the mast in position; for example, poured concrete.

It will be appreciated that the modular elements may be used to construct a temporary or a permanent structure. For example, the elements with the height of Hm=1 m may be suited to a temporary structure, whereas the elements with the height of Hm=2 may be suited to constructing a permanent structure.

It will also be appreciated that other modular system heights may be used, other that 1 m and 2 m examples mentioned above. Similarly, variant embodiments have different aspect ratios of lateral dimension and height dimension may be achieved, in which the height dimension is greater than the lateral dimension and in which the lateral dimension is greater than the height dimension.

The invention claimed is:

1. A kit of parts which kit is arranged to be connected together so as to form an assembled structure, wherein the kit comprises:

a modular structural element which is of substantially square outline or of substantially hexagonal or half-hexagonal outline, and the element comprises a principal height dimension and a principal lateral dimension, wherein, a ratio of the two said principal dimensions is no more than 6;

two interplates which are each of plate configuration and arranged to be located at opposite distal ends of a modular structural element, and the interplate has a larger principal lateral dimension than the modular structural element;

a plurality of poles which have a length which matches the principal height dimension of modular element;

wherein, the poles arranged to be located externally of the structural modular element between two interplates.

2. The kit of claim 1, wherein the ratio of the modular structural is no more than at least one of 1.5 1.75, 2, 2.25 2.5 2.75, 3, 3.25, 3.5, 3.75, 4, 4.25, 4.5, 4.75, 5, 5.25, 5.5 and 5.75.

3. The kit of claim 1, wherein the ratio of the modular structural element is between 1.0 and 2.5.

4. The kit of claim 1, which further comprises a modular structural element of claim 1 which comprises a half hexagonal modular element, and which is arranged to be attached to a second hexagonal modular element to form a modular structural element of hexagonal outline.

5. The kit of claim 1, wherein the modular structural element of claim 1 is a hollow entity comprising an internal void.

6. The kit of claim 5 in which the distal ends of the modular element are open distal ends.

7. The kit as claimed in claim 1, in which the modular structural element of claim 1 comprises sides which extend from one distal end to an opposite distal end, and any side is provided with one or more apertures.

8. The kit as claimed in claim 7, in which said sides of the modular structural element are of non-solid configuration.

9. The kit as claimed in claim 1 in which the modular structural element of claim 1 which weighs less than 50 kg.

10. The kit of parts as claimed in claim 1 which comprises a plurality of the modular structural.

11. The kit of parts as claimed in claim 1 in which an internal space of a hexagonal modular structural element, formed as a unitary entity or by joining two half hexagonal elements, is configured so as to receive a square modular element therein.

12. The kit of parts as claimed in claim 10 which comprises at least two different elements from a hexagonal element, a half hexagonal element and a square element, which are of substantially the same principal height dimension.

13. The modular structure which comprises multiple modular elements, assembled together, comprising the kit of parts as claimed in claim 1.

14. The modular structure as claimed in claim 13 which is at least one of an upright structure in which the modular elements are arranged in a vertical formation and a lateral formation in which the modular elements are arranged in a side-by-side formation.

15. The modular structure as claimed in claim 14 in which for the vertical formation, a lower portion of which comprises multiple hexagonal modular elements placed in a vertical direction, and an upper portion comprises multiple square modular elements placed in a vertical direction.

16. The modular structure as claimed in claim 15 in which the lower portion is substantially devoid of square modular elements, and/or the upper portion is substantially devoid of hexagonal modular elements.

17. The modular structure as claimed in claim 16 in which there is an intermediate portion located between the upper portion and lower portion, in which at least one square modular element is received in at least one hexagonal modular element.

* * * * *